US011739722B2

(12) United States Patent
Carugati et al.

(10) Patent No.: US 11,739,722 B2
(45) Date of Patent: Aug. 29, 2023

(54) ELECTRONIC DEVICE AND CONTROL SYSTEM OF AN IGNITION COIL IN AN INTERNAL COMBUSTION ENGINE

(71) Applicant: ELDOR CORPORATION S.P.A., Orsenigo (IT)

(72) Inventors: Eugenio Carugati, Rovellasca (IT); Pasquale Forte, Castiglione d'Orcia (IT); Stefano Silva, Cantù (IT)

(73) Assignee: ELDOR CORPORATION S.P.A.

( * ) Notice: Subject to any disclaimer, the term of this patent is extended or adjusted under 35 U.S.C. 154(b) by 0 days.

(21) Appl. No.: 17/631,747

(22) PCT Filed: Jul. 30, 2020

(86) PCT No.: PCT/IB2020/057187
§ 371 (c)(1),
(2) Date: Jan. 31, 2022

(87) PCT Pub. No.: WO2021/019484
PCT Pub. Date: Feb. 4, 2021

(65) Prior Publication Data

US 2022/0275783 A1 Sep. 1, 2022

(30) Foreign Application Priority Data

Aug. 1, 2019 (IT) ..... 102019000013755

(51) Int. Cl.
*F02P 11/06* (2006.01)
*F02P 17/12* (2006.01)
(Continued)

(52) U.S. Cl.
CPC ..... *F02P 3/0435* (2013.01); *F02P 11/00* (2013.01); *F02P 11/06* (2013.01); *F02P 17/12* (2013.01)

(58) Field of Classification Search
CPC .. F02P 11/00; F02P 11/06; F02P 17/12; F02P 2017/125
(Continued)

(56) References Cited

U.S. PATENT DOCUMENTS 5,534,781 A 7/1996 Lee
5,913,302 A 6/1999 Ruman et al.
(Continued)

FOREIGN PATENT DOCUMENTS

EP 0810369 A2 12/1997
EP 0922857 A1 6/1999
(Continued)

OTHER PUBLICATIONS

International Search Report and Written Opinion dated Dec. 4, 2020 from counterpart International Patent Application No. PCT/IB2020/057187.

*Primary Examiner* — Erick R Solis
(74) *Attorney, Agent, or Firm* — SHUTTLEWORTH & INGERSOLL, PLC; Timothy J. Klima

(57) ABSTRACT

An electronic device for controlling an ignition coil of an internal combustion engine includes a high voltage switch, a driving unit and a control unit. The driving unit controls the closure of the switch during charging energy in the primary winding and the opening of the switch during transferring energy from the primary winding to a secondary winding. A current measuring circuit is connected in series to a second terminal of the secondary winding to detect current generated on the secondary winding during the charging step and generate a signal representative of the detected current. The control unit receives the signal representative of the current detected by the measuring circuit, compares a relevant value of such signal with a predefined first reference value and activates a mode for detecting a
(Continued)

soiling of the spark plug when the relevant value of the signal exceeds said predefined first reference value.

5 Claims, 14 Drawing Sheets

(51) Int. Cl.
*F02P 3/04* (2006.01)
*F02P 11/00* (2006.01)

(58) Field of Classification Search
USPC ..... 123/406.14, 406.27; 73/114.08, 114.67
See application file for complete search history.

(56) References Cited

U.S. PATENT DOCUMENTS

| | | | | |
|---|---|---|---|---|
| 2007/0186902 | A1* | 8/2007 | Zhu | G01L 23/221 123/406.28 |
| 2013/0206106 | A1 | 8/2013 | Huberts et al. | |
| 2015/0176558 | A1 | 6/2015 | Glugla et al. | |
| 2017/0350364 | A1 | 12/2017 | Wuestenhagen et al. | |

FOREIGN PATENT DOCUMENTS

| | | | |
|---|---|---|---|
| EP | 1081375 | A2 | 3/2001 |
| EP | 1138940 | A2 | 10/2001 |

* cited by examiner

ELECTRONIC DEVICE AND CONTROL SYSTEM OF AN IGNITION COIL IN AN INTERNAL COMBUSTION ENGINE

This application is the National Phase of International Application PCT/IB2020/057187 filed Jul. 30, 2020 which designated the U.S.

This application claims priority to Italy Patent Application No. 102019000013755 filed Aug. 1, 2019, which application is incorporated by reference herein.

TECHNICAL FIELD OF THE INVENTION

The present invention relates in general to the field of electronic ignition of an internal combustion engine, such as an engine of a motor vehicle.

More in particular, the present invention relates to a method for monitoring a soiling condition of an ignition spark plug for a combustion engine.

Furthermore, the present invention relates to a method, device and control system of an ignition coil in an internal combustion engine.

Furthermore, the invention relates to an electronic device for controlling an ignition coil of an internal combustion engine and related electronic ignition system which is capable of detecting a misfire of a comburent-combustible mixture (e.g., oxygen in the air as the comburent and fuel as the combustible) in an engine cylinder, by measuring the ionization current generated in the cylinder under consideration.

KNOWN ART

Modern internal combustion engines for motor vehicles are equipped with analytical systems of the internal combustion process, in order to maximize the efficiency and performance of the engine itself.

In particular, such analytical systems are generally integrated or associated with ignition systems, which thanks to the presence of the spark plug electrodes inside the combustion chamber can be used to measure (electrical) quantities useful for defining the combustion conditions or detecting possible anomalies in the cylinder.

In some applications, for example, it is known to use the ignition system to determine whether or not the spark plug needs to be replaced.

In this respect, document US2017/0350364 provides for detecting the flowing current in the secondary winding at the start of the energy transfer step between the primary and secondary winding.

More precisely, this document provides for measuring the time interval between the opening of the switch on the primary winding and the creation of the arc between the spark plug ends, determining a condition of necessary replacement of the spark plug when this time interval is greater than a predetermined threshold value.

Disadvantageously, this system has strong sensitivity limits, especially when the engine is at low rpm (very low breakdown voltage).

In publications EP1081375 and EP1138940, on the contrary, the flowing current in the secondary winding is measured during discharge, i.e., following the establishment of the arc between the electrodes.

The detected current signal is integrated and compared with a reference value; if the comparison shows that the integral value of the detected current is less than the reference value, the control unit determines that the spark plug has reached a wear condition which requires replacement.

Disadvantageously, such systems prevent detection of the soiling/wear condition in the absence of spark, which may not occur precisely in the presence of such conditions, making the system unsustainable.

In some other applications, the ignition system is used to detect typical combustion parameters.

For example, it is known to measure the ionization current to obtain indicative data of parameters of the combustion process of the air-fuel mixture directly from the combustion chamber.

In particular, the spark plug is used as a sensor of ions (typically $CHO^+$, $H_3O^+$, $C_3H_3^+$, $NO_2^+$ type) which are generated in the combustion chamber after the spark has been generated between the spark plug electrodes and the combustion of the air-fuel mixture has occurred.

The ionization current is then generated by applying a potential difference to the spark plug electrodes and measuring the current generated by means of the ions produced in the combustion chamber.

By measuring the ionization current it is possible to detect a misfire of the air-fuel mixture in real time (more generally, of a mixture of a comburent with a combustible) and then promptly take appropriate actions to avoid engine failures.

U.S. Pat. No. 5,534,781 A1 discloses a system for detecting the ionization current which uses (see FIGS. 1 and 2) an integrating circuit 45 to calculate a voltage proportional to the integral of the ionization current.

The integrating circuit 45 is based on an operational amplifier 46 and comprises two diodes 40, 42 in parallel connected in opposite directions and a series connection of a resistor 44 and a capacitor 48.

The output signal generated by the integrating circuit 45 is read by the Electronic Control Unit (ECU) 10.

The Applicant has observed that the integrating circuit 45 of U.S. Pat. No. 5,534,781 A1 is overly complex, since it requires the use of an operational amplifier 46 and a number of other electronic components.

In addition, U.S. Pat. No. 5,534,781 does not mention the manner in which the information regarding the detection of a misfire is transmitted from the coil 25 to the Electronic Control Unit 10.

BRIEF SUMMARY OF THE INVENTION

An object of the present invention is therefore to provide a method for monitoring a soiling condition of an ignition spark plug for a combustion engine, as well as a control method, device and system of an ignition coil in an internal combustion engine which are able to overcome the drawbacks of the prior art mentioned above.

In particular, an object of the present invention is to provide a method for monitoring a soiling condition of an ignition spark plug for a combustion engine which is reliable and easily operable.

In addition, an object of the present invention is to provide a method for controlling an ignition coil in an internal combustion engine which is robust and which facilitates the identification of a degree of soiling of the spark plug.

In addition, a further object of the present invention is to provide a control device and system of an ignition coil in an internal combustion engine which are efficient and at the same time simple to implement.

Said objects are achieved by a control device and system having the technical features of one or more of the following claims.

In particular, the objects of the present invention are achieved by an electronic device capable of implementing a method for monitoring a soiling condition of an ignition spark plug for an internal combustion engine in which the engine comprises an ignition system comprising at least one ignition coil provided with at least one primary winding and one secondary winding, at least one ignition spark plug electrically connected in series to said secondary winding and at least one voltage generator electrically coupled to said primary winding by at least one high voltage switch.

The monitoring method is implemented during the charging and discharging cycles of an ignition coil for a combustion engine, in which the primary winding is cyclically charged with energy for a first time interval and the energy charged in the primary winding is subsequently transferred to the secondary winding by electromagnetic induction at the end of said first time interval.

The first time interval corresponds to a step of charging the primary winding, while the transfer of energy takes place in a transfer step.

According to an aspect of the invention, during the first time interval (i.e., during the charging step), the flowing current on the secondary winding is detected, of which a relevant value (e.g., peak value, average value or integral value) is identified.

This relevant value is compared to at least a predefined first reference value (or threshold).

If the comparison shows that the significant current value is greater than the first reference value, the soiling condition of the spark plug is identified.

In this regard, it should be noted that preferably the relevant value represents the module/absolute value of the real detected value, as the current which is created in the secondary due to soiling generally has a negative sign (compared to the primary).

The term "soiling" herein refers to defining that at least part of the spark plug, in particular the ceramic insulator of the central electrode, is covered with a soot deposit which, being of carbonaceous origin, is conductive.

Thanks to the method object of the invention, the Applicant has exploited this peculiarity of the carbon layer (unwanted), monitoring whether also in a step in which the secondary current should be substantially zero a current flow is generated due to the soiling of the spark plug.

Advantageously, thanks to this intuition it has been possible to obtain an efficient and reliable spark plug monitoring process, thanks to which it is possible to detect the soiling condition of the spark plug without particular time constraints and even in the absence of spark, avoiding all the drawbacks of the prior art described above.

Preferably, in order to accurately determine the presence or absence of soiling on the spark plug, the first reference value I_thr is between 80 μA and 8000, preferably between 100 μA and 2000 μA.

More preferably, there may be more than one predefined reference value, in order to expand the monitoring and identify not only the presence of a spark plug soiling, but also the degree/level of soiling.

In this regard, preferably the comparison step involves comparing said relevant value of the secondary current also with at least a second reference value, less than said first reference value.

At this point, a low soiling condition of the spark plug is identified if said relevant value is greater than said second reference value but less than said first reference value.

Instead, a condition of high soiling of the spark plug is identified if the relevant value is greater than the first reference value.

In accordance with a further aspect of the invention, i.e., the coil control method, a spark plug cleaning procedure is started if a soiling condition (low and/or high) of the spark plug is identified.

That is, if said relevant value of the secondary current is greater than said first (and/or second) reference value, the control method involves starting the spark plug cleaning procedure.

Preferably, such cleaning procedure provides for an increase in temperature at the spark plug electrodes in order to eliminate (or reduce) the carbon residues.

According to a further aspect of the invention, complementary or alternative to those listed heretofore, the Applicant has perceived that the electronic control device and the ignition system can detect the degree of soiling of the spark plug, a pre-ignition of the mixture or a misfire of a combu-rent-combustible mixture (for example, an air-fuel mixture) in the combustion chamber of the engine cylinder by measuring the value of the integral of the ionization current with an integrating circuit which is very easy to realize, reliable and accurate enough for the application in question, also considerably reducing the computational calculation required of the Electronic Control Unit positioned outside the coil.

The integrating circuit is reliable because it reduces the risk of detecting false misfire alarms or false events of the presence of combustion, as it provides the Electronic Control Unit with the value of the integral of the ionization current, by means of which the Electronic Control Unit can detect the presence or absence of a misfire.

With reference to the soiling of the spark plug, the integrating circuit allows the detection in a simple and reliable way during the step of charging energy in the primary winding.

In this regard, preferably the measuring circuit comprises a bias circuit connected in series to a second terminal of the secondary winding and configured to generate a current during the detection of the current on the secondary winding and an integrating circuit interposed between the bias circuit and a reference voltage.

The integrating circuit comprises an integrating capacitor connected in series to the bias circuit and connected between the bias circuit and the reference voltage.

The integrating capacitor is configured to:

- pre-charge during said charging step by means of a current flowing through the secondary winding during said charging step;
- maintain the charge state substantially constant during the charging step when the current flowing in the secondary winding is substantially zero;
- completely discharge by means of the current flowing through the secondary winding during the step of transferring energy from the primary winding to the secondary winding.

More preferably, the control unit is configured to:

- compare a value representative of the current stored in the integrating capacitor with said predefined first reference value;
- activate said mode for detecting a soiling of the spark plug when said representative value exceeds said predefined first reference value.

Furthermore, the electronic control device and the electronic ignition system according to this aspect of the present invention provide at least two possible, particularly efficient solutions for transferring the information of the measurement of the integral of the ionization current to an Electronic Control Unit positioned outside the coil, in order to detect spark plug soiling, a misfire of the comburent-combustible mixture and/or the presence of pre-ignition of the comburent-combustible mixture in the energy charging step in the primary winding.

BRIEF DESCRIPTION OF THE DRAWINGS

Additional features and advantages of the invention will become more apparent from the description which follows of a preferred embodiment and the variants thereof, provided by way of example with reference to the appended drawings, in which.

DETAILED DESCRIPTION OF THE INVENTION

It should be observed that in the following description, identical or analogous blocks, components or modules are indicated in the figures with the same numerical references, even where they are illustrated in different embodiments of the invention.

Figure 1:
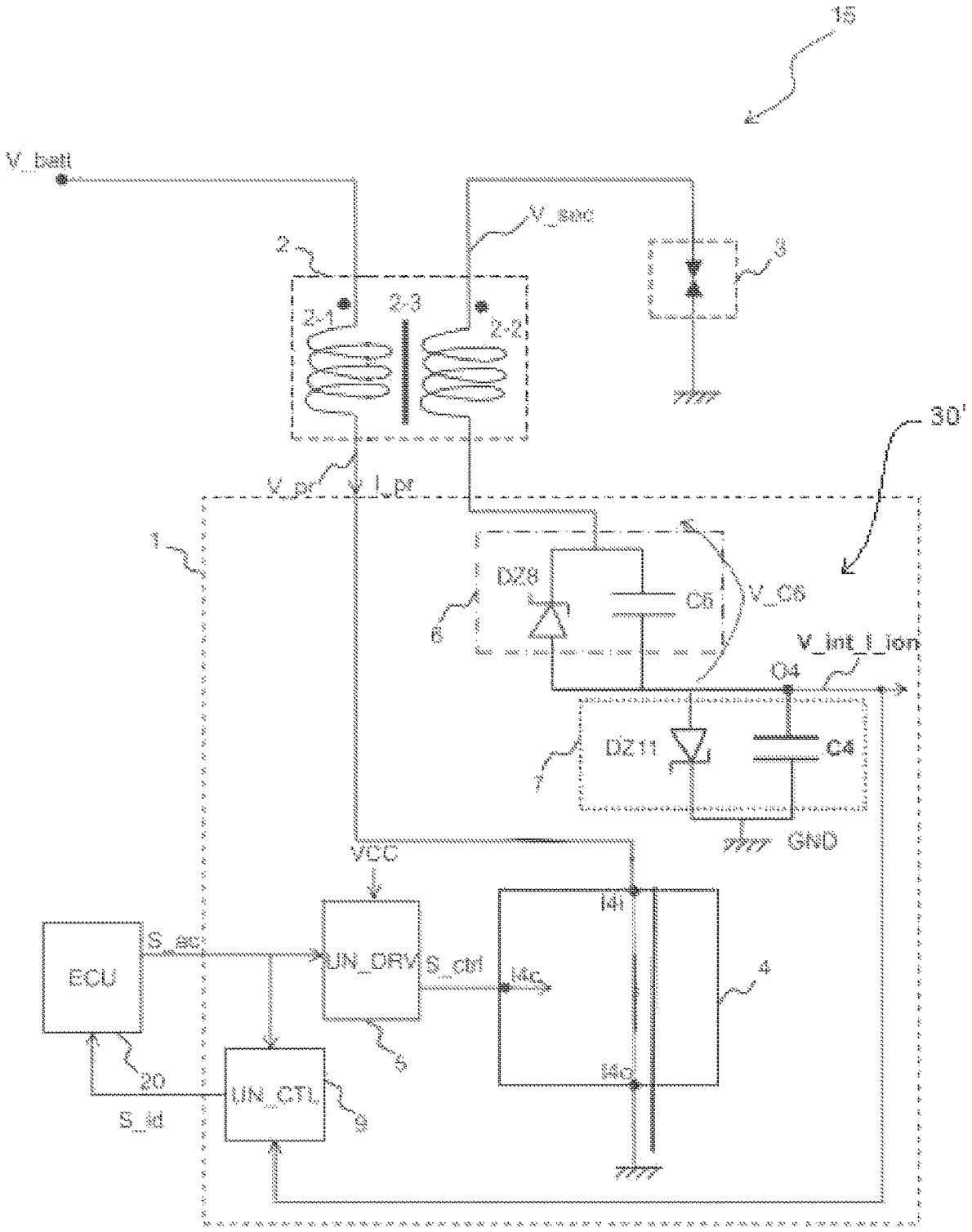
FIG. 1 shows a block diagram of an electronic ignition system according to an embodiment of the invention.
Figure 1A:
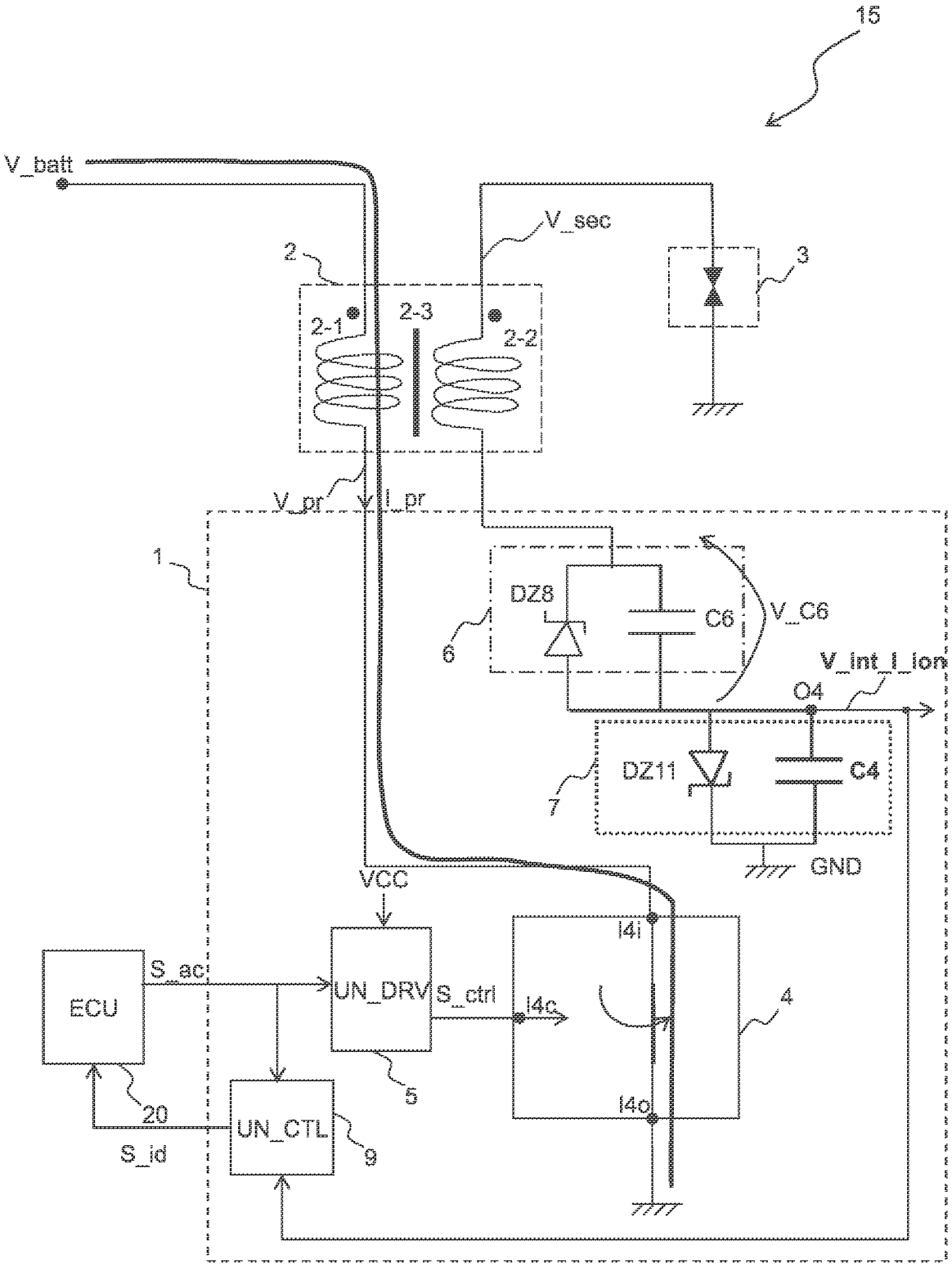
FIGS. 1A-1C show the block diagrams of the ignition system of FIG. 1 indicating the current flows.
Figure 1B:
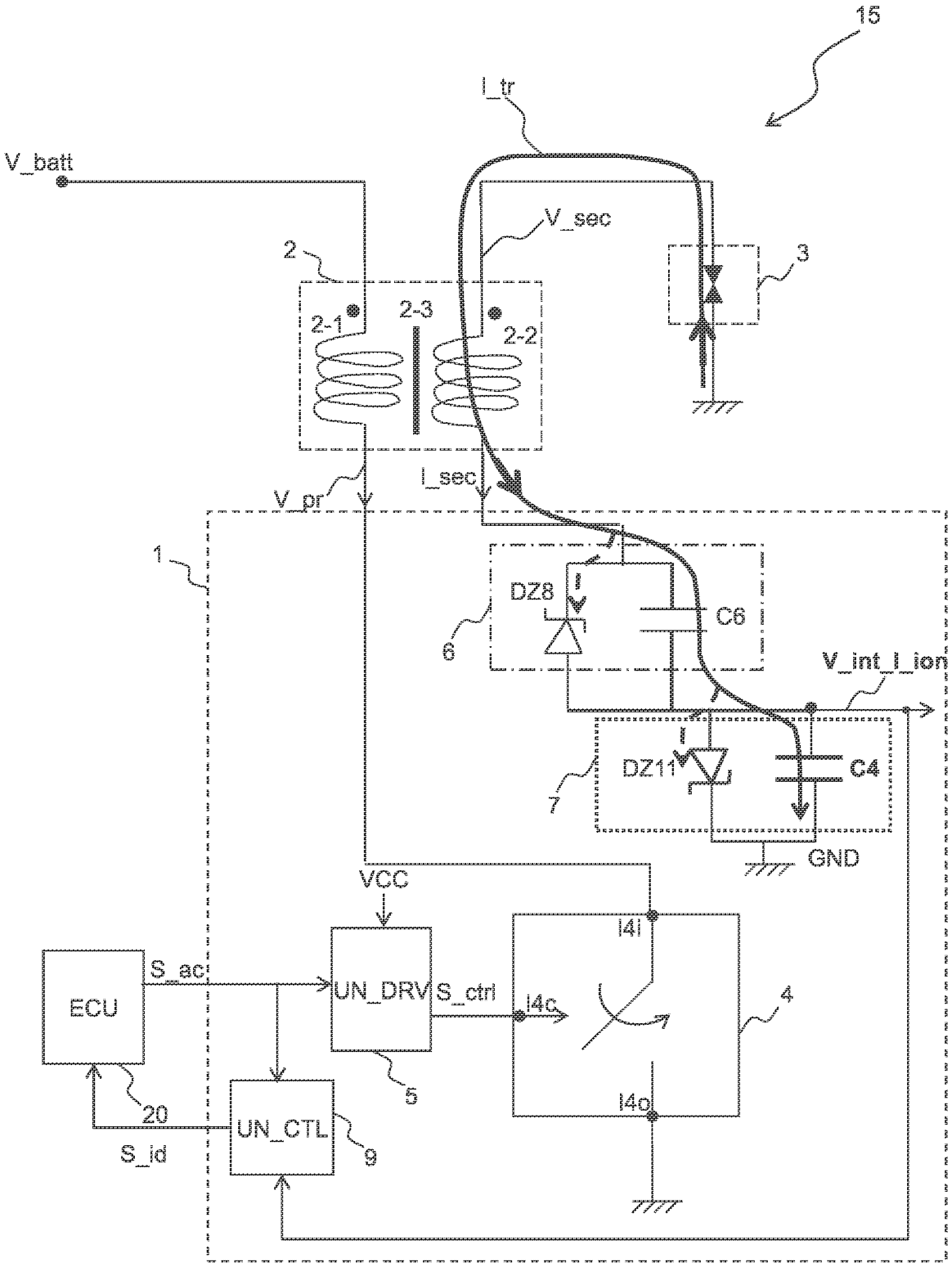
Figure 1C:
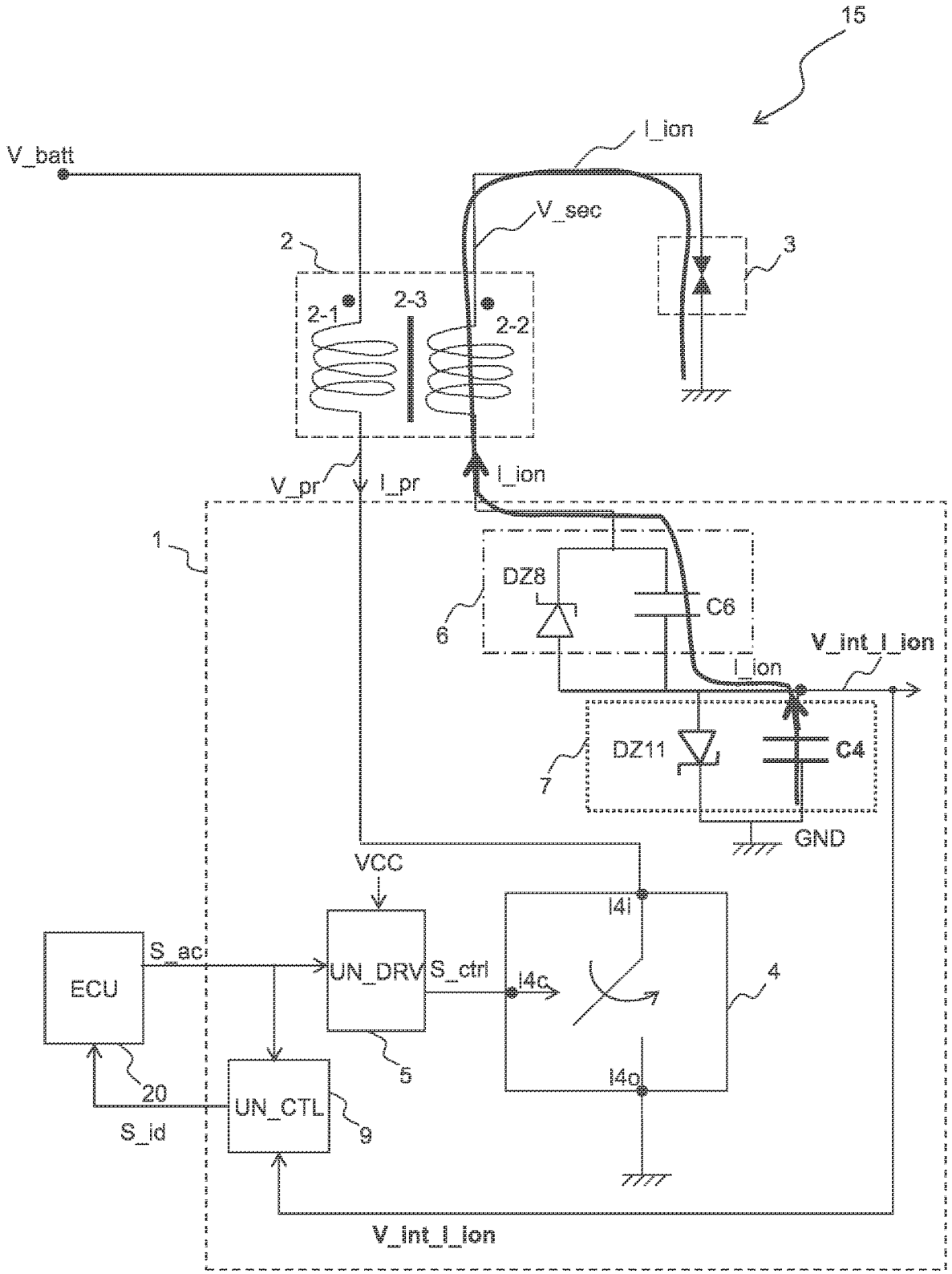

With reference to FIGS. 1A, 1B, 1C, an electronic ignition system 15 is illustrated for an internal combustion engine according to the embodiment of the invention.

The electronic ignition system 15 can be mounted on any motorized vehicle, such as for example a motor vehicle, a motorcycle or a lorry.

The ignition system 15 comprises:

an ignition coil 2;

a spark plug 3;

an electronic control device 1;

an Electronic Control Unit 20.

The Electronic Control Unit 20 (commonly indicated with ECU) is a processing unit (for example a microprocessor) which is positioned far enough away from the head of the internal combustion engine, so as not to be influenced by the high working temperature of the ignition coil 2.

The electronic control device 1 and the coil 2 are instead positioned near the engine head and are designed to tolerate the high working temperatures of the engine head.

The spark plug 3 is connected to the secondary winding 2-2 of the ignition coil 2.

In particular, the spark plug 3 comprises a first electrode connected to the secondary winding 2-2 and comprises a second electrode connected to the ground reference voltage.

The spark plug 3 has the function of generating a spark across the electrodes thereof and the spark enables burning the air-fuel mixture contained in a cylinder of the internal combustion engine.

It should be observed that for the purposes of explanation of the invention, an air-fuel mixture is considered in the following, but more in general the invention is applicable to a mixture of a comburent (also different from air) with a combustible (also different from fuel).

The ignition coil 2 has a primary winding 2-1, a secondary winding 2-2 and a magnetic core 2-3 for inductively coupling the primary winding 2-1 with the secondary winding 2-2.

The ignition system 15 is such as to function on the basis of three operating steps:

- a first step of charging, in which the energy charge in the primary winding 2-1 is carried out, by means of the primary current I_pr which flows through the primary winding 2-1 with an increasing trend;
- a second energy transfer step, in which the transfer of energy is carried out the primary winding 2-1 to the secondary winding 2-2, thus generating the spark on the electrodes of the spark plug 3 and therefore burning the air/fuel mixture contained in the cylinder of the internal combustion engine;
- a third step of measuring the ionization current, in which the measurement is made of the integral of the ionization current I_ion, as will be explained in more detail in the following.

The third step of measuring the ionization current further comprises a chemical step and a subsequent thermal step.

The electronic control device 1 comprises:

a driving unit 5;

a high voltage switch 4;

a bias circuit 6;

an integrating circuit 7;

a local control unit 9.

Preferably, the electronic control device 1 is a single component which is enclosed in a housing, i.e., the driving unit 5, the high voltage switch 4, the bias circuit 6 and the integrating circuit 7 are enclosed in a single housing; for example, the driving unit 5, the high voltage switch 4, the bias circuit 6 and the integrating circuit 7 are mounted on the same printed circuit board.

Alternatively, the bias circuit 6 and the integrating circuit 7 are enclosed in a single housing, while the driving unit 5 and the high voltage switch 4 are outside said housing; for example, the driving unit 5 and/or the high voltage switch 4 are enclosed within the Electronic Control Unit 20.

The primary winding 2-1 comprises a first terminal adapted to receive a battery voltage V_batt (for example, equal to 12 Volts) and further comprises a second terminal connected to the high voltage switch 4 and adapted to generate a primary voltage V_pr.

Furthermore, in the following a "voltage drop across the primary winding 2-1" will refer to the potential difference between the first terminal and the second terminal of the primary winding 2-1.

The secondary winding 2-2 is connected to the ignition spark plug 3; in particular, the secondary winding 2-2 comprises a first terminal connected to a first electrode of the spark plug 3 and adapted to generate a secondary voltage V_sec and comprises a second terminal connected towards a ground reference voltage through the bias circuit 6 and the integrating circuit 7 as shown in FIGS. 1A-1C.

In the following "primary current" I_pr will be used to indicate the current flowing through the primary winding 2-1 and "secondary current" I_sec will be used to indicate the current flowing through the secondary winding 2-2 during the second step of transferring energy from the primary winding 2-1 to the secondary winding 2-2.

Preferably, a resistor is interposed between the spark plug 3 and the secondary winding 2-2, having the function of attenuating the noise.

The high voltage switch 4 is connected in series to the primary winding 2.1.

The term "high voltage" means that the voltage of the terminal I4*i* of the switch 4 is greater than 200 Volts.

In particular, the high voltage switch 4 comprises a first terminal I4*i* connected to the second terminal of the primary winding 2.1, comprises a second terminal I4*o* connected to the ground reference voltage and comprises a control terminal I4*c* connected to the driving unit 5.

The high voltage switch 4 is switchable between a closed position and an open position, as a function of the value of a control signal S_ctrl received on the control terminal I4*c*.

The high voltage switch 4 is preferably realized by an IGBT type transistor (Insulated Gate Bipolar Transistor) having a collector terminal which coincides with the terminal I4*i*, having an emitter terminal which coincides with the terminal I4*o* and having a gate terminal which coincides with the terminal I4*c*; in this case the primary voltage V_pr is therefore equal to the voltage of the collector terminal of the IGBT transistor 4.

In particular the IGBT transistor 4 is such as to function in the saturation zone when it is closed and in the inhibition zone when it is open.

The IGBT transistor 4 is such as to function with voltage values greater than 200 Volts.

Alternatively, the high voltage switch 4 can be realized with a field effect transistor (MOSFET, JFET) or with two bipolar junction transistors (BJT) or it can be a solid-state switch (relay).

The driving unit 5 is supplied with a supply voltage VCC less than or equal to the battery voltage V_batt.

For example, if it is supposed that the value of the battery voltage V_batt is 12 V, the value of the supply voltage VCC can be 8.2 V, 5 V or 3.3 V.

The bias circuit 6 has the function of biasing the spark plug 3 so as to generate a flow of ionization current I_ion during the third step of measuring the ionization current, as will be explained in more detail below.

The bias circuit 6 is interposed between the second terminal of the secondary winding 2-2 and the integrating circuit 7.

Preferably, the bias circuit 6 comprises the parallel connection of a first capacitor C6 (hereinafter indicated with "bias capacitor") and a first Zener diode DZ8, electrically connected as shown in FIGS. 1A-1C.

The bias capacitor C6 comprises a first terminal connected to the cathode terminal of the first Zener diode DZ8, which are connected to the second terminal of the secondary winding 2-2.

The bias capacitor C6 comprises a second terminal connected to the integrating circuit 7.

The bias capacitor C6 has the function of generating electrical energy to force the ionization current I_ion to flow after the end of the spark of the plug 3.

In fact, the bias capacitor C6 is charged during the second step of transferring energy from the primary winding to the secondary winding and is discharged at least partially by means of the ionization current I_ion during the third step of measuring the ionization current I_ion.

In the following V_C6 will be used to indicate the voltage drop across the bias capacitor C6.

It should be noted that the value of the capacitance of the bias capacitor C6 is much lower than the value of the capacitance of the capacitors used in bias circuits according to the known solutions which measure the ionization current, as will be explained in more detail in the following.

For example, the capacitance of the bias capacitor C6 is comprised between 10 nanofarad and 150 nanofarad.

Figure 2A:
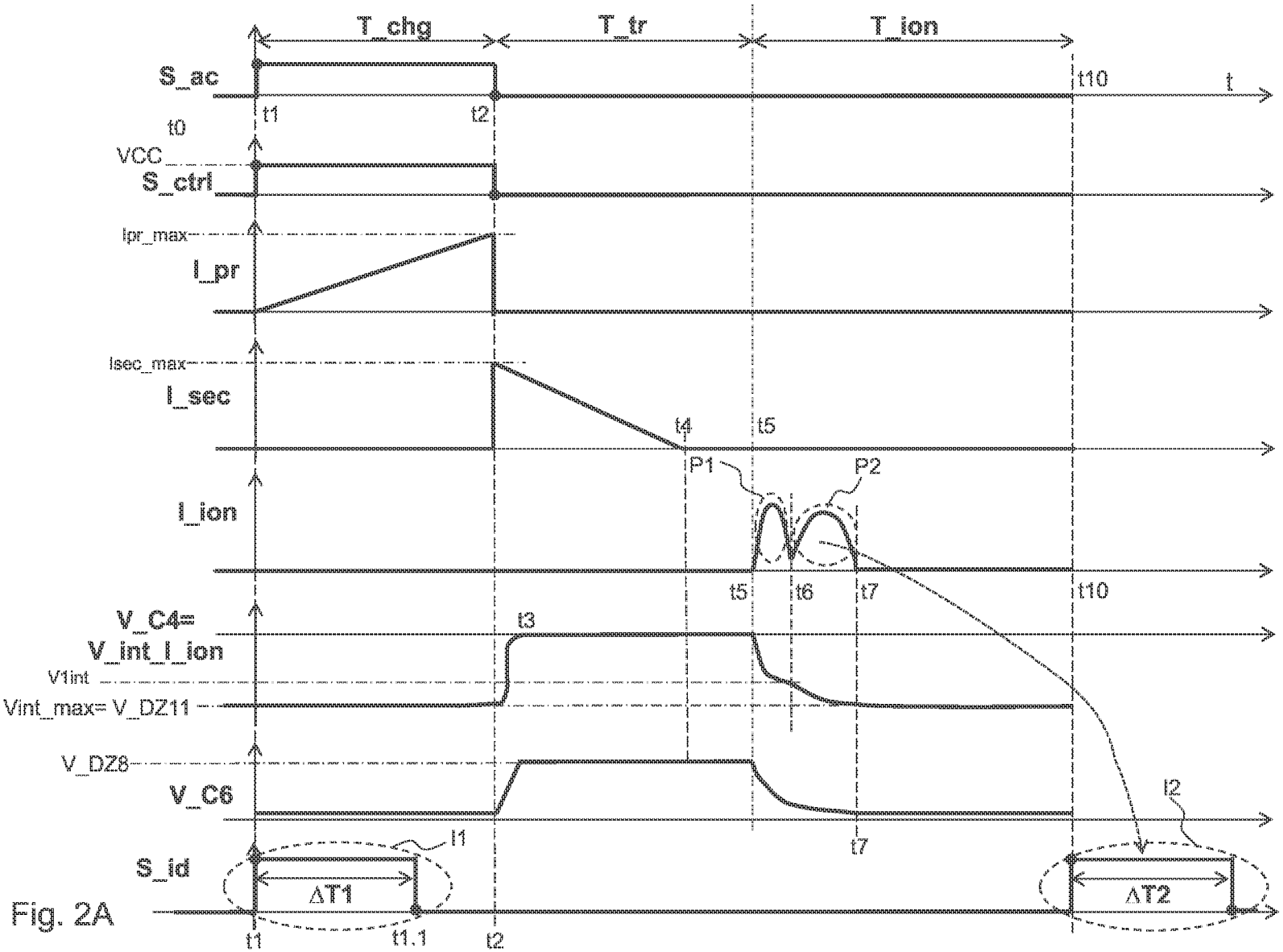
FIGS. 2A-2C schematically show a possible trend of some signals generated in the electronic ignition system during three combustion cycles according to the embodiment of the invention, in the case in which two correct ignitions of the comburent-combustible mixture and a misfire of the comburent-combustible occur.

In the third step of measuring the ionization current the bias capacitor C6 can be discharged (partially or fully) both approximately at the end of the ionization current (as shown in FIG. 2A), or shortly after or shortly before the end of the ionization current I_ion.

The first Zener diode DZ8 comprises the cathode terminal connected to the second terminal of the secondary winding 2-2 and comprises the anode terminal connected to the integrating circuit 7.

The first Zener diode DZ8 is such as to have a first mode of operation in which the voltage drop across itself is equal to the Zener voltage Vz (for example, equal to 200 Volts) when it is reversely biased (i.e., when the voltage of the anode terminal is less than that of the cathode terminal), and is such as to have a second mode of operation in which it operates as a normal diode when it is forwardly biased (i.e., when the voltage of the anode terminal is greater than that of the cathode terminal, for example approximately 0.7 Volts).

During the second step of transferring energy the first Zener diode DZ8 is reversely biased and has the function of limiting the value of the voltage across the bias capacitor C6 which is charged up to reaching a maximum value equal to the Zener voltage of the first Zener diode DZ8, which will be indicated hereinafter with V_DZ8 (for example, V_DZ8 is equal to 200 Volts).

During the third step of measuring the ionization current the first Zener diode DZ8 is forwardly biased; for example, the voltage across the first Zener diode DZ8 is equal to about 0.7 Volts.

The integrating circuit 7 has the function of measuring the value of the integral of the ionization current I_ion, performing a current-voltage conversion and generating an integrating voltage signal V_int_I_ion representative of the value of the integral of the ionization current I_ion measured during the third step of the ignition cycle, as will be explained in more detail in the following.

The integrating circuit 7 is connected between the bias circuit 6 and the ground reference voltage.

During the second step of transferring energy (in which the spark on the electrodes takes place) the resetting of the integrating circuit 7 is carried out so as to allow measuring the integral of the ionization current I_ion during the third step, as will be explained in more detail in the following.

More in particular, the integrating circuit 7 comprises the parallel connection of a second capacitor C4 (hereinafter indicated with "integrating capacitor") and a second Zener diode DZ11, as shown in FIGS. 1A-1C.

The integrating capacitor C4 comprises a first terminal connected to the anode terminal of the second Zener diode DZ11, which are connected to the bias circuit 6, in particular connected to the second terminal of the bias capacitor C6 and the anode terminal of the first Zener diode DZ8.

The integrating capacitor C4 further comprises a second terminal connected to the cathode terminal of the second Zener diode DZ11, which are connected to the ground reference voltage.

The integrating capacitor C4 has the function of storing (during the third step of measuring the ionization current I_ion) the charge generated by the flow of the ionization current I_ion, measuring therefore a value which is a function of the integral of the ionization current I_ion; in particular, the value measured by means of the integrating capacitor C4 increases (for example, directly proportional) with the increase in the value of the integral of the ionization current I_ion.

Furthermore, the integrating capacitor C4 is automatically completely discharged (of its possible residual charge) during the second step of transferring energy by means of the pulse of the secondary current I_sec which flows through the secondary winding 2-2, i.e., when the spark occurs between the electrodes of the spark plug 3.

Therefore the integrating voltage signal V_int_I_ion represents the voltage across the integrating capacitor C4, which is a function (for example, is directly proportional) of the value of the integral of the ionization current I_ion measured during the third step of measuring the ionization current I_ion.

The second Zener diode DZ11 comprises the anode terminal connected to the first terminal of the integrating capacitor C4, which are connected to the bias circuit 6, in particular connected to the second terminal of the bias capacitor C6 and the anode terminal of the first Zener diode DZ8.

The second Zener diode DZ11 also comprises the cathode terminal connected to the integrating capacitor C4, which are connected to the ground reference voltage.

The second Zener diode DZ11 is such as to have a first mode of operation in which the voltage across itself is equal to the Zener voltage Vz (for example, equal to 15 Volts) when it is reversely biased (i.e., when the voltage of the anode terminal is less than that of the cathode terminal), and is such as to have a second mode of operation in which it operates as a normal diode when it is forwardly biased (i.e., when the voltage of the anode terminal is greater than that of the cathode terminal by approximately 0.7 Volts).

During the third step of measuring the ionization current I_ion, the second Zener diode DZ11 is reversely biased and has the function of limiting the value of the integrating voltage V_int_I_ion across the integrating capacitor C4 to a maximum value equal to the Zener voltage V_DZ11 of the second Zener diode DZ11, in the case in which the value of the integrating voltage V_int_I_ion in the third step reaches a high value: this allows connecting (directly or indirectly) the first terminal of the integrating capacitor C4 to the local control unit 9 (for example, a small microprocessor), without damaging it.

For example, the Zener voltage V_DZ11 of the second Zener diode DZ11 is equal to 15 Volts and thus the value of the integrating voltage V_int_I_ion across the integrating capacitor C4 is limited to a value Vint_max=V_DZ11=−15 Volts, i.e., the voltage drop across the integrating capacitor C4 (during the third step of measuring the ionization current) is limited to a defined negative value of −15 Volts.

During the second step of transferring energy the second Zener diode DZ11 is forwardly biased and has the function of maintaining the voltage across the integrating capacitor C4 at a substantially null value; for example, during the second step of transferring energy the voltage across the integrating capacitor C4 is limited to a positive value equal to approximately 0.7 Volts.

The Electronic Control Unit 20 has the function of controlling the operation of the ignition coil 2, with the aim of generating the spark across the spark plug 3 at the correct instant.

In particular, the Electronic Control Unit 20 comprises an output terminal adapted to generate the ignition signal S_ac having a transition from a first to a second value (for example, from a logical low to high value) so as to terminate the first step of charging the primary winding 2-1 and activate the second step of transferring energy from the primary winding 2-1 to the secondary winding 2-2, as will be explained in more detail in the following.

The driving unit 5 (for example, a micro-controller) has the function of controlling the operation of the high voltage switch.

The driving unit 5 comprises a first input terminal adapted to receive an ignition signal S_ac having a transition from one value to another (for example, a transition from a logical high to low value, or vice versa) and comprises a first output terminal adapted to generate, as a function of the value of the ignition signal S_ac, the control signal S_ctrl for driving the opening or closing of the high voltage switch 4.

In particular, the driving unit 5 is configured so as to receive the ignition signal S_ac having a first value (for example a logical high value) and so as to generate the control signal S_ctrl having a first value (for example, a voltage value greater than zero) for driving the closing of the high voltage switch 4.

Furthermore, the driving unit 5 is configured so as to receive the ignition signal S_ac having a second value (for example a logical low value) and so as to generate the control signal S_ctrl having a second value (for example, a null voltage value) for driving the opening of the high voltage switch 4, thus brusquely interrupting the primary current flow I_pr which flows through the primary winding 2-1: this causes a voltage pulse on the second terminal of the primary winding 2-1 of a brief length, typically with peak values of 200-450 V and having a length of a few microseconds.

Consequently, the energy stored in the primary winding 2-1 is transferred onto the secondary winding 2-2; in particular a high-value voltage pulse is generated on the first terminal of the secondary winding 2-2, typically 15-50 kV, which is sufficient to trigger the spark between the electrodes of the spark plug 3.

The local control unit 9 (for example, a microprocessor or a micro-controller) has the function of collecting and transferring to the Electronic Control Unit 20 the information of the value of the integral of the ionization current I_ion, for the purpose of detecting the presence or absence of a misfire of the air-fuel mixture in the combustion chamber of the cylinder in which the spark plug 3 is positioned, by means of the use of a separate communication channel.

The misfire can be caused for example by a faulty injector, or by the faulty spark plug 3 or by other causes inside the combustion chamber, such as a soiling condition of the spark plug 3.

The local control unit 9 is electrically connected to the integrating circuit 7 and to the Electronic Control Unit 20.

According to a first aspect of the invention, the local control unit 9 comprises a first input terminal adapted to receive the ignition signal Sac, comprises a second input terminal adapted to receive the integrating voltage signal V_int_I_ion representative of the voltage V_C4 across the integrating capacitor C4 of the integrating circuit 7 (i.e., representative of the integral of the ionization current I_ion) and comprises an output terminal adapted to generate a combustion monitoring voltage S_id carrying a voltage pulse for each cycle (see I1, I2, I3, I4 in FIGS. 2A-C) having a length ΔT (see ΔT1, ΔT2, ΔT3, ΔT4 in FIGS. 2A-C) which depends on the measured value of the integral of the ionization current I_ion in the previous cycle, i.e., ΔT is a function of the detected value of the integrating voltage V_int_I_ion in the previous cycle.

It should be noted that the value of the integrating voltage V_int_I_ion generated during the third step of measuring the ionization current I_ion has a negative trend and an inverter is therefore used inside the control unit 9 so as to generate an integrating voltage having a positive trend.

The combustion monitoring voltage S_id will be used by the Electronic Control Unit 20 to detect in each combustion cycle the presence or absence of a misfire of the air-fuel mixture in the combustion chamber of the cylinder in which the spark plug 3 is mounted, as will be explained in more detail in the following.

In particular, the length ΔT of the voltage pulse of the combustion monitoring voltage S_id is a function (for example, is directly proportional) of the measured value of the integral of the ionization current I_ion in the previous ignition cycle, i.e., it is a function (for example, directly proportional) of the value of the integrating voltage V_int_I_ion detected across the integrating capacitor C4 in the previous ignition cycle.

Figure 2B:
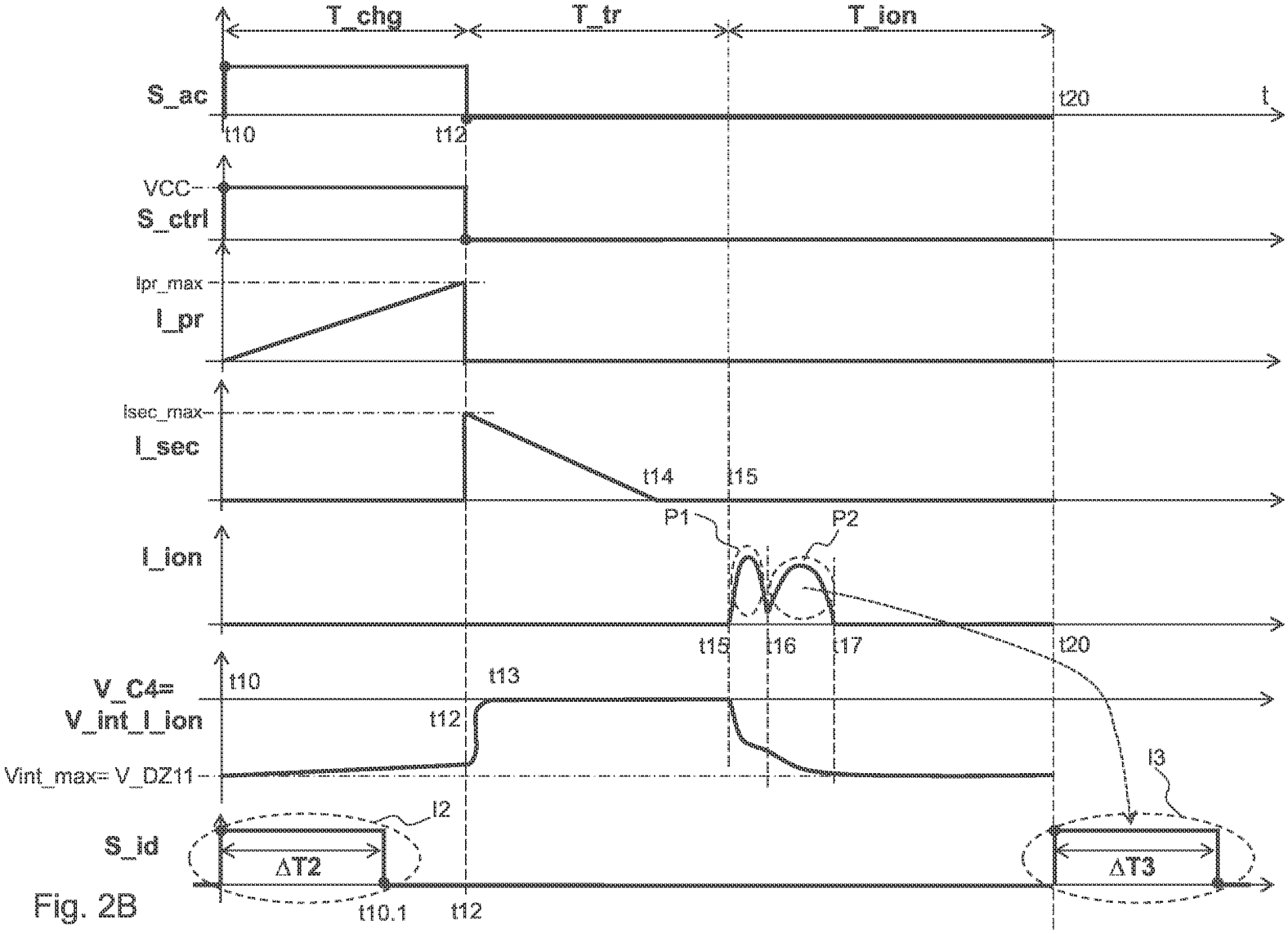
Figure 2C:
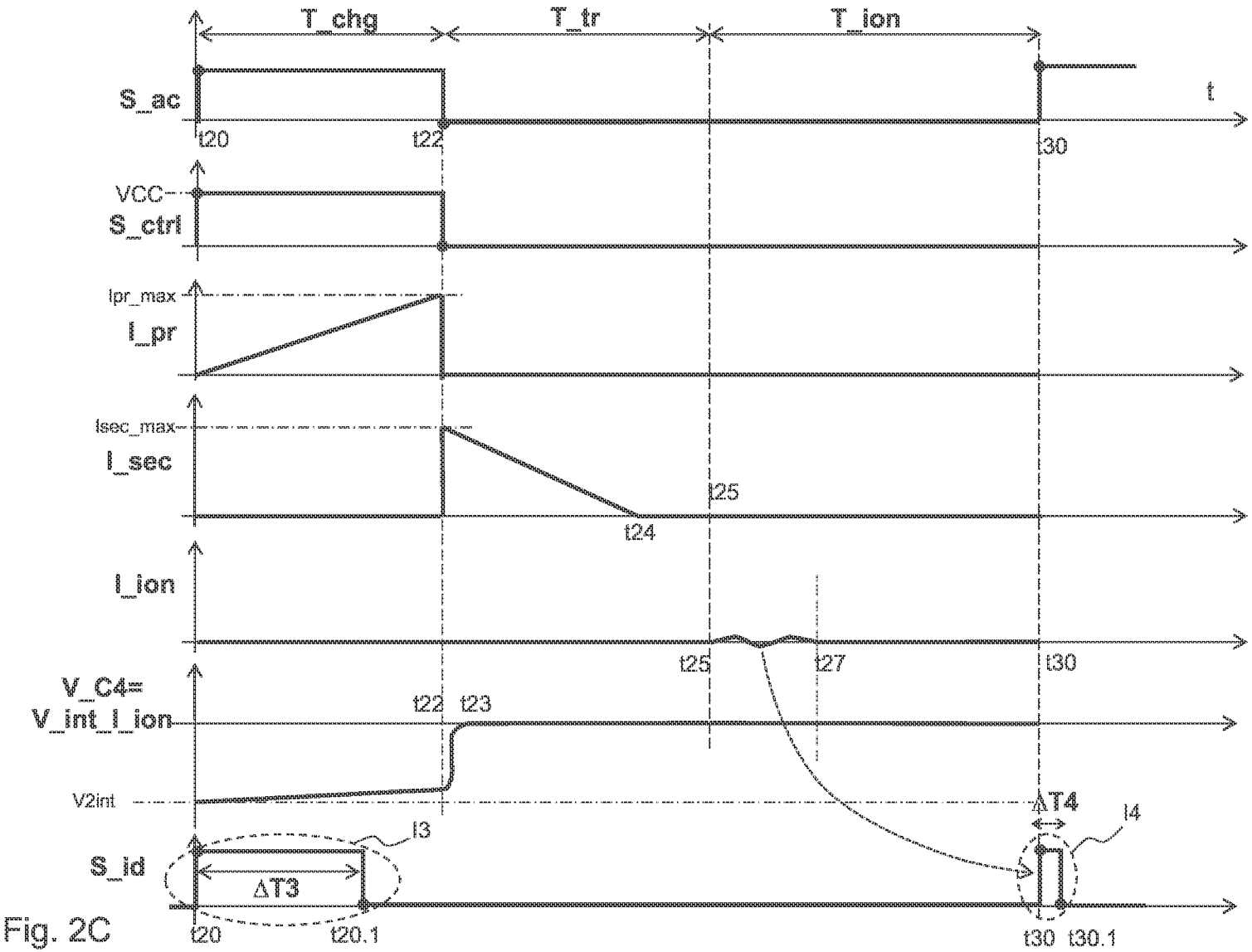

The control unit 9 in the previous cycle is therefore configured to generate the combustion monitoring voltage S_id as a function of the ignition signal S_ac and as a function of the integrating voltage signal V_int_I_ion carrying the measured value of the integral of the ionization current I_ion in the previous ignition cycle:

- when the ignition signal S_ac has an increasing edge (see the instants t1, t10, t20, t30 in FIG. 2A-C), an increasing edge is generated in the voltage pulse of the combustion monitoring voltage S_id (see the increasing edges of the voltage pulses I1, I2, I3, I4 in FIG. 2A-C):
- the length ΔT of the voltage pulse of the combustion monitoring voltage S_id is a function (for example, directly proportional) of the value of the integrating voltage V_int_I_ion of the step of measuring the ionization current I_ion in the previous ignition cycle (see the decreasing edges at the instants t1.1, t10.1, t20.1, t30.1 of the pulses I1, I2, I3, I4 with the respective lengths ΔT1, ΔT2, ΔT3, ΔT4 in FIG. 2A-C).

The Electronic Control Unit 20 therefore has the further function of detecting the presence or absence of a misfire of the air-fuel mixture in the combustion chamber of the cylinder in which the spark plug 3 is mounted.

In this case the Electronic Control Unit 20 comprises an input terminal adapted to receive the combustion monitoring voltage S_id carrying, for each ignition cycle, a voltage pulse having a length ΔT which depends on the measured value of the integral of the ionization current I_ion.

The Electronic Control Unit 20 is therefore configured to detect, as a function of the measured value of the integral of the ionization current I_ion, the presence or absence of a misfire of the air-fuel mixture in the combustion chamber of the cylinder in which the spark plug 3 is mounted.

More in particular, the Electronic Control Unit 20 performs, for each ignition cycle, a comparison of the length ΔT of the voltage pulse (which depends on the measured value of the integral of the ionization current I_ion) with respect to an ignition threshold, in order to detect the presence or absence of a misfire in each ignition cycle.

Advantageously, the value of the ignition threshold is variable and depends on the operating conditions of the engine, such as for example the number of engine revolutions and the engine load.

The Electronic Control Unit 20 also has the function of detecting, as a function of the measured value of the integral of the ionization current I_ion, a presence or absence of a pre-ignition of the air-fuel mixture or a soiling of the spark plug 3, i.e., the presence of an undesired current level during the step of charging the primary winding 2-1 is detected.

FIG. 1A shows the electronic ignition system 15 during the first step of charging energy in the primary winding 2-1, in which the high voltage switch 4 is closed: in this configuration a current flow I_chg flows (see FIG. 1A) from the battery voltage V_batt towards ground, crossing the first primary winding 2-1, and the high voltage switch 4; therefore the value of said current flow I_chg is equal to the value of the primary current I_pr flowing in the primary winding 2-1.

FIG. 1B shows the electronic ignition system 15 during the second step of transferring energy from the primary winding 2-1 to the secondary winding 2-2, in which the high voltage switch 10 is open: in this configuration a current flow I_tr flows (see FIG. 1B) through the spark plug 3, the secondary winding 2-2, the bias circuit 6 and the integrating circuit 7.

FIG. 1C shows the electronic ignition system 15 during the third step of measuring the ionization current I_ion and shows the generation of the integrating voltage signal V_int_I_ion representative of the value of a measurement of the integral of the ionization current I_ion.

It can be observed that the high voltage switch 4 is open and the ionization current I_ion flows through the integrating circuit 7, the bias circuit 6, the secondary winding 2-2 and the spark plug 3 (see FIGS. 1C and 2C again).

With reference to FIGS. 2A-2C, a possible trend of the ignition signal S_ac, the control signal S_ctrl, the primary current I_pr, the secondary current I_sec, the ionization current I_ion, the integrating voltage V_int_I_ion and the combustion monitoring voltage S_id is shown according to the embodiment of the invention.

It should be noted that for the purposes of explaining the invention, FIGS. 2A-2C show the signal of the secondary current I_sec separate from that of the ionization current I_ion, but in reality it is the current which flows through the secondary winding 2-2 in two different steps of operation of the electronic ignition system 15, respectively in the second step of transferring energy having a length T_tr and in the third step of measuring the ionization current having a length T_ion: this separation is also useful because the order of magnitude of the current is different, i.e., hundreds of mA [milli Amperes] in the case of the secondary current I_sec in the second step of transferring energy and hundreds of μA [micro Amperes] in the case of the ionization current I_ion.

Note that the signals represented in FIGS. 2A-C are not in scale and that the content of the description takes precedence over the values derived from the signals.

FIG. 2A shows a first ignition cycle comprised between t1 and t10 and FIG. 2B shows a second ignition cycle comprised between the instants t10 and t20: in both cycles a correct combustion of the air-fuel mixture occurs in the combustion chamber of the cylinder in the engine, i.e., a correct spark occurs between the electrodes of the spark plug 3.

Otherwise, FIG. 2C shows a third ignition cycle comprised between the instants t10 and t20 in which a misfire of the air-fuel mixture occurs in the combustion chamber of the cylinder in the engine, i.e., in the second step of transferring energy a spark does not occur between the electrodes of the spark plug 3.

The trend of the signals continues in ignition cycles subsequent to the third, of which only a portion of a fourth cycle following the third cycle is shown.

It can be observed for the first and second ignition cycle that the three steps of operation of the electronic ignition system 15 are present:

- the first step of charging the primary winding 2-1 has a length T_chg and is comprised between the instants t1 and t2 for the first cycle, between the instants t10 and t12 for the second cycle: in these instants the integrating circuit 7 begins to be reset, in particular the integrating capacitor C4 begins to discharge slowly and is partially discharged through the charge seen from the terminal O4 of the integrating capacitor C4;
- the second step of transferring energy from the primary winding 2-1 to the secondary winding 2-2 has a length T_tr and is comprised between the instants t2 and t5 for the first cycle, between the instants t12 and t15 for the second cycle: in these instants it is supposed that the spark is correctly generated across the electrodes of the spark plug 3, the integrating circuit 7 is reset (in particular, the integrating capacitor C4 is quickly discharged towards a substantially null value) and moreover the bias capacitor C6 of the bias circuit 6 is charged until it reaches the value of the Zener voltage V_DZ8 of the first Zener diode DZ8;
- the third step of measuring the ionization current and generation of the integrating voltage V_int_I_ion has a length T_ion and is comprised between the instants t5 and t10 for the first cycle, between the instants t15 and t20 for the second cycle: in these instants the bias capacitor C6 of the bias circuit 6 operates as a generator of electrical energy to force the ionization current I_ion to flow and therefore the bias capacitor C6 of the bias circuit 6 is discharged at least partially by means of the flow of the ionization current I_ion, moreover a value is measured (by means of the detection of the integrating voltage V_int_I_ion across the integrating capacitor C4) which is a function (for example, directly proportional) of the integral of the ionization current I_ion by means of the charging of the integrating capacitor C4 until the integrating voltage V_int_I_ion reaches a maximum value Vint_max (limited to the Zener voltage V_DZ11 of the Zener diode DZ11, in the case in which the value of the integral of the ionization current I_ion is a high value).

Moreover, it can be observed that also for the third ignition cycle three steps of operation of the electronic ignition system 15 are present:

- the first step of charging the primary winding 2-1 has a length T_chg and is comprised between the instants t20 and t22: in these instants the charging of energy is carried out in the primary winding 2-1 and the integrating capacitor C4 is partially and slowly discharged;
- the second step of transferring energy from the primary winding 2-1 to the secondary winding 2-2 has a length T_tr and is comprised between the instants t22 and t25: in these instants it is supposed that a misfire of the air-fuel mixture occurs in the combustion chamber in which the spark plug 3 is mounted;
- the third step of measuring the ionization current and generation of the integrating voltage V_int_I_ion has a length T_ion and is comprised between the instants t25 and t30: unlike the third step of the first and second cycle, in this third step of the third cycle the ionization current I_ion is substantially null due to a misfire of the air-fuel mixture and therefore the integrating capacitor C4 is not charged (i.e., it remains discharged at a substantially null value, for example 0.7 Volts), therefore a substantially null value (i.e., very small) is measured (by means of the detection of the integrating voltage V_int_I_ion) of the integral of the ionization current I_ion.

In more detail, in the first step of charging (instants comprised between t1 and t2 for the first cycle, between t10 and t12 for the second cycle and between t20 and t22 for the third cycle) the high voltage switch 4 is closed, the primary current I_pr has an increasing trend from the null value to the maximum value Ipr_max, the value of the secondary current I_sec is substantially null, the ionization current I_ion is null and the integrating voltage signal V_int_I_ion is null (first cycle) or increases slowly (second cycle) towards the value of substantially null.

In the second step of transferring energy (time interval comprised between t2 and t5 for the first cycle, between t12 and t15 for the second cycle and between t22 and t25 for the third cycle) the following operation occurs:

- the high voltage switch 4 is open, the primary current I_pr is substantially null, the secondary current I_sec has at the instants t2 (first cycle), t12 (second cycle) and t22 (third cycle) a pulse of maximum value Isec_max and then has a decreasing trend from the maximum value Isec_max until reaching the substantially null value respectively at the instants t4 (first cycle), t14 (second cycle) and t24 (third cycle);
- the capacitor C4 discharges quickly and therefore the integrating voltage signal V_int_I_ion first quickly increases towards the null value at the beginning of the second cycle (i.e., between the instants t2 and t3 for the first cycle, between the instants t12 and t13 for the second cycle, between the instants t22 and t23 for the third cycle) until reaching a substantially null value (for example, approximately 0.7 Volts equal to the voltage across the forwardly biased Zener diode DZ11) and then the integrating voltage signal V_int_I_ion is maintained equal to a substantially null value (for example, approximately 0.7 Volts) for the remaining time interval of the second cycle (i.e., between the instants t3 and t5 for the first cycle, between the instants t13 and t15 for the second cycle, between the instants t25 and t25 for the third cycle);
- the ionization current I_ion is null during the entire second step of the first, second and third cycle.

In particular, the integrating voltage V_int_I_ion is the voltage drop V_C4 across the integrating capacitor C4 and therefore during the second step of transferring energy of the second cycle the integrating capacitor C4 discharges until reaching complete discharge at the instant t13 (not far from t12) in which the voltage drop across the integrating capacitor C4 is substantially null (for example, 0.7 Volts equal to the voltage drop across the forwardly biased Zener diode DZ11).

In the third step of measuring the ionization current (time interval comprised between t5 and t10 for the first cycle, between t15 and t20 for the second cycle and between t25 and t30 for the third cycle) the high voltage switch 4 is open.

The primary current I_pr has null values after the instant t2 for the first cycle, after the instant t12 for the second cycle and after the instant t22 for the third cycle.

The secondary current I_sec is null in the instants comprised between t4 and t10 for the first cycle, between t14 and t20 for the second cycle and between t24 and t30 for the third cycle.

Furthermore the ionization current I_ion flows through the secondary winding 2-2 at the instants comprised between t5 and t7 for the first cycle and between t15 and t17 for the second cycle since the correct combustion of the air-fuel mixture occurred in the first and second cycle.

In particular, in the third step of measuring the ionization current of the first and second cycle, the ionization current I_ion has a first current peak P1 (chemical step) in the instants comprised between t5 and t6 for the first cycle and between t15 and t16 for the second cycle, then there is a second current peak P2 (thermal step) between the instants t6 and t7 for the first cycle and between t16 and t17 for the second cycle, then the ionization current I_ion has a substantially null value from the instant t7 for the first cycle and from the instant t17 for the second cycle.

Otherwise, in the third step of the third cycle the ionization current I_ion is also substantially null between the instants t25 and t27, since there was a misfire of the air-fuel mixture.

Furthermore in the third step of measuring the ionization current of the first and second cycle (instants comprised between t5 and t10 for the first cycle and between t15 and t20 for the second cycle) the integrating voltage V_int_I_ion instead has a decreasing monotonic trend starting from a substantially null value at the instant t5 for the first cycle and t15 for the second cycle, until reaching a maximum negative value Vint_max (equal for example to the Zener voltage V_DZ11 of the Zener diode DZ11): the detected value of the integrating voltage V_int_I_ion at a given instant of time in the third step of measuring the ionization current of the first and second cycle represents (minus the sign) the area subtended by the ionization current I_ion up to the instant of time considered, i.e., the measurement of the integral of the ionization current I_ion.

In particular, the integrating voltage V_int_I_ion is the voltage drop V_C4 across the integrating capacitor C4 and therefore during the third step of measuring the ionization current of the first and second cycle the charging of the integrating capacitor C4 is carried out, which charge is limited to a negative value so that the voltage across the integrating capacitor C4 reaches a maximum negative value Vint_max equal to the Zener voltage V_DZ11 across the Zener diode DZ11 which is reversely biased.

For example, the Zener voltage V_DZ11 of the second Zener diode DZ11 is equal to 15 Volts, therefore the value of the integrating voltage V_int_I_ion is limited to the value Vint_max=V_DZ11=−15 Volts, i.e., during the third step of measuring the ionization current of the first and second cycle the voltage across the integrating capacitor C4 is limited to a defined negative value equal for example to −15 Volts.

Otherwise, in the third step of measuring the ionization current of the third cycle (instants comprised between t25 and t30) the integrating voltage V_int_I_ion instead has a substantially null trend due to the misfire of the air-fuel mixture and therefore the detected value of the integrating voltage V_int_I_ion at a given instant of time in the third step of measuring the ionization current of the third cycle is a very small value (i.e., approximately null), namely the measurement of the integral of the ionization current I_ion is a very small value (i.e., approximately null).

The following will describe the operation of the ignition system 15 according to the embodiment of the invention in three ignition cycles comprised between the instants t1 and t30 and a portion of a fourth ignition cycle subsequent to t30, with reference also to FIGS. 1A-1C and 2A-C.

For the purposes of the explanation of the operation the following hypotheses are considered:

- the reference voltage V_ref is equal to the ground reference voltage;
- battery voltage V_batt=12 V;
- supply voltage VCC=5 V;
- the high voltage switch 4 is realized by a IGBT transistor;
- the bias circuit 6 is realized with the parallel connection of the bias capacitor C6 and the Zener diode DZ8;
- the integrating circuit 7 is realized with the parallel connection of the integrating capacitor C4 and the Zener diode DZ11;
- it is assumed that the integrating capacitor C4 at the initial instant t1 is charged, in particular the voltage across the integrating capacitor C4 is equal to the Zener voltage V_DZ11 of the Zener diode DZ11 (for example, −15 Volts);
- the control signal S_ctrl is a voltage signal;
- the ignition signal S_ac and the control signal S_ctrl have logical values in which the logical low value is 0 V and the logical high value is equal to the supply voltage VCC=5 V.
- the ratio between the turns of the coil 2 is N;
- in the case of a correct combustion of the air-fuel mixture, the length ΔT of the pulses of the combustion monitoring voltage S_id is directly proportional to the detected value of the integrating voltage V_int_I_ion.

It is assumed to start from a condition in which a proper ignition of the air-fuel mixture occurred in the ignition cycle prior to the instant t1.

At instant t1 the first ignition cycle starts and the Electronic Control Unit 20 generates the ignition signal S_ac having a transition from the logical low value to the logical high value (equal to the supply voltage VCC) which indicates the start of the charging step.

The driving unit 5 receives the ignition signal S_ac equal to the logical high value and generates, on the control terminal of the IGBT transistor 4, the control voltage signal S_ctrl having a value equal to the logical high value which closes the IGBT transistor 4 (see the configuration of FIG. 1A).

Furthermore at the instant t1 the local control unit 9 receives the detected value of the integrating voltage V_int_I_ion and generates the combustion monitoring voltage S_id having a voltage pulse I1 with a rising edge.

As the IGBT transistor 4 is closed, the first step of charging energy begins in the primary winding 2-1 in which the primary current I_pr begins to flow from the battery voltage V_batt towards the ground reference voltage, passing through the primary winding 2-1 and the IGBT transistor 4.

The primary voltage V_pr has a transition from the value V_batt to the saturation voltage value Vds_sat, the voltage of the first terminal of the primary winding 2.1 remains equal to V_batt and therefore the voltage drop across the primary winding 2-1 has a transition from the null value to the value equal to V_batt−Vds_sat; furthermore, the secondary voltage V_sec has a transition from the null value to the value N*(V_batt−Vds_sat).

The operation in the instants comprised between t1 and t2 (excluding t2) is similar to the operation described at instant t1, with the following differences.

In particular,

- the control voltage signal S_ctrl maintains the value equal to the logical high value (equal to the supply voltage VCC), which maintains the IGBT transistor 4 closed;
- the primary current I_pr which flows through the primary winding 2-1 has an increasing trend, which continues to charge the primary winding 2-1 with energy;
- the voltage of the first terminal of the primary winding 2.1 remains equal to V_batt;
- the primary voltage V_pr has an increasing trend as the primary current I_pr increases;
- the voltage drop across the primary winding 2.1 has a decreasing trend;
- the secondary voltage V_sec has a decreasing trend from the value N*V_batt to the value N*(V_batt−Vds_sat), with a trend which follows that of the primary voltage V_pr minus the value of the turns N ratio;
- the integrating capacitor C4 is maintained charged at the value of the Zener voltage of the Zener diode DZ11 and therefore the integrating voltage V_int_I_ion has a substantially constant trend equal to the value of the Zener voltage of the Zener diode DZ11 (for example, −15 Volts).

Moreover in the instants comprised between t1 and t2 the ionization current I_ion is null and the integrating voltage V_int_I_ion is also null.

Finally in the instants comprised between t1 and t2 the local control unit 9 receives the detected value of the integrating voltage V_int_I_ion and generates, as a function of said detected value of the integrating voltage V_int_I_ion, the combustion monitoring voltage S_id having at the instant t1.1 a descending edge of the voltage pulse I1, thus generating a pulse I1 having a length ΔT1 directly proportional to the detected value of the integrating voltage V_int_I_ion in the ignition cycle (not shown in the figures) preceding the first cycle and in which it is assumed that a correct ignition of the air-fuel mixture has occurred: said length ΔT1 will be used by the Electronic Control Unit 20 to detect the presence or absence of a misfire of the air-fuel mixture in the combustion chamber of the cylinder of the engine in which the spark plug 3 is mounted.

At instant t2 the Electronic Control Unit 20 generates the ignition signal S_ac having a transition from the logical high value (equal to the supply voltage VCC) to the logical low value which indicates the end of the first step of ignition and the start of the step of transferring energy from the primary winding 2-1 to the secondary winding 2-2.

The driving unit 5 receives the ignition signal S_ac equal to the logical low value and generates on the control terminal of the IGBT transistor 4 the control voltage signal S_ctrl having a logical low value which opens the IGBT transistor 4 (see the configuration of FIG. 1B).

Since the IGBT transistor 4 is opened, the current flow I_chg from the battery voltage V_batt towards ground through the primary winding 2-1 is brusquely interrupted and therefore the energy (previously stored in the primary winding 2-1) starts being transferred onto the secondary winding 2-2.

Consequently the primary voltage V_pr has a pulse of a high value (typically equal to 200-450 V) and short length (typically a few microseconds), the primary current I_pr brusquely decreases from the maximum value Ipr_max to null value, the secondary current I_sec has a pulse of value Isec_max and the secondary current V_sec has a pulse of a very high value (for example 30 KV), which triggers the spark across the electrodes of the spark plug 3.

Furthermore at the instant t2 the charging of the bias capacitor C6 also begins by means of the pulse of the secondary current I_sec and the rapid and complete discharging of the integrating capacitor C4 begins: therefore in the second step of transferring energy the voltage across the integrating capacitor C4 first has a rapid transition towards a substantially null value and is then maintained equal to the substantially null value (for example, a positive value equal to approximately 0.7 Volts by means of the forward biasing of the Zener diode DZ11).

Note that for the sake of simplicity the primary current I_pr has been assumed to have an instantaneous transition from the maximum value Ipr_max to the null value at time instant t2, but in reality said transition occurs in a time interval which lasts for example between 2 and 15 microseconds: in this case the absolute value of the secondary voltage V_sec has an increasing trend with a high slope to the maximum value and the spark is emitted when the absolute value of the secondary voltage V_sec has reached the maximum value (and therefore when the primary current I_pr has reached the null value).

In the instants comprised between t2 and t5 (excluding t5) the spark between the electrodes of the spark plug 3 is maintained and therefore the combustion of the air-fuel mixture continues.

The operation is similar to that described at the instant t2, thus the IGBT transistor 4 remains inhibited.

Consequently, the value of the primary current I_pr is maintained at zero, while the secondary current I_sec has a decreasing trend starting from the maximum value Isec_max.

In the instants between t2 and t3 the secondary current I_sec flows through the secondary winding 2-2 and then through the bias capacitor C6 which is charged; in a certain instant the secondary current I_sec (which flows through the secondary winding 2-2) begins to flow through the Zener diode DZ8, which is then reversely biased and limits the voltage V_C6 across the bias capacitor C6 equal to the Zener voltage V_DZ8 of the first Zener diode DZ8 (for example, the Zener voltage V_DZ8 of the Zener diode DZ8 is equal to 200 V).

Moreover in the instants following t2 the secondary current I_sec (which flows through the secondary winding 2-2 and then through the bias capacitor C6 or the Zener diode DZ8 as illustrated above) flows through the integrating capacitor C4 which rapidly discharges and thus the voltage across the integrating capacitor C4 has a rapid transition from the maximum negative value Vint_max towards a substantially null value.

Therefore while the bias capacitor C6 is charging (or while the bias capacitor C6 is already charged and is limited to the value of the Zener voltage V_DZ8 of the Zener diode DZ8), the integrating capacitor C4 rapidly discharges the residual charge which it had previously stored, so as to be ready to measure in the third step the value of the integral of the ionization current I_ion.

In a certain instant following t2 the secondary current I_sec (which flows through the secondary winding 2-2 and then through the bias capacitor C6 or through the Zener diode DZ8 as illustrated above) begins to flow through the Zener diode DZ11 which is forwardly biased and thus at the instant t3 the voltage V_C4 across the integrating capacitor C4 (and therefore the integrating voltage V_int_I_ion) is a positive value equal to approximately 0.7 Volts: since this value is very small with respect to the values of the Zener voltage V_DZ11 of the Zener diode DZ11, it was indicated above (and also indicated in FIG. 2A) that the integrating capacitor C4 in the second step discharges down to reaching a "substantially null" value of the voltage V_C4 across itself.

Moreover in the instants comprised between t2 and t5 the ionization current I_ion is null and the integrating voltage V_int_I_ion is also null.

At instant t5 it is possible to begin the measurement of the ionization current, as at the previous instant t4 the value of the secondary current I_sec has reached a null value and it is therefore possible to measure only the contribution of the current generated at the electrodes of the spark plug 3 following the ions generated during the combustion of the air-fuel mixture.

Therefore the third step starts at the instant t5: the bias circuit 6 starts to generate a flow of the ionization current I_ion which flows through the secondary winding 2-2 and thus the integrating circuit 7 starts to measure the value of the integral of the intensity of the ionization current I_ion.

In particular, at the instant t5 the bias capacitor C6 operates as a generator of electrical energy (by means of the charge stored in the previous second step) and starts the discharge of the bias capacitor C6 by means of the ionization current I_ion.

Moreover at the instant t5 the charging of the integrating capacitor C4 starts towards a negative value, by means of the storage of electric charge generated by the ions generated in the combustion chamber after the end of the spark, and therefore at the instant t5 the measurement of the value of the integral of the ionization current I_ion starts.

More in particular, in the instants comprised between t5 and t6 the first peak P1 of the value of the ionization current I_ion is generated (by means of the bias circuit 6), representative of the current generated by the ions produced during the chemical step of the step of measuring the ionization current, and moreover the value proportional to the integral of the intensity of the ionization current I_ion is measured (by means of the integrating circuit 7, in particular by means of the integrating capacitor C4 which is charging), generating the integrating voltage signal V_int_I_ion.

Therefore in the instants comprised between t5 and t6 the charging of the integrating capacitor C4 continues and the integrating voltage V_int_I_ion has a decreasing trend from the null value at the instant t5 to a first negative value V1int at the instant t6 (for example, V1int=−2 Volts).

Similarly, in the instants comprised between t6 and t7 the second peak P2 of the value of the ionization current I_ion is generated (by means of the bias circuit 6), representative of the current generated by the ions produced during the thermal step of the third step of measuring the ionization current, and the measurement (by means of the integrating circuit 7, in particular by means of the integrating capacitor C4) also continues of the value proportional to the integral of the intensity of the ionization current I_ion, generating the integrating voltage signal V_int_I_ion; therefore in the instants comprised between t6 and t7 the charging of the integrating capacitor C4 continues and the integrating voltage V_int_I_ion continues to have a decreasing trend from the first value V1int at the instant t6 to a maximum negative value Vint_max (greater in absolute value than V1int) at the instant t7 (for example, Vint_max=−15 Volts).

In the instants comprised between t7 and t10 the ionization current I_ion has a substantially null value since the activity on the electrodes of the spark plug 3 has ended, the integrating capacitor C4 maintains the charge and the integrating voltage V_int_I_ion has a constant trend equal to the maximum negative value Vint_max.

In the hypothesis in which the measured value of the integral of the ionization current reaches (in the instants comprised between t6 and t7 of the third step) a high value, the reverse biasing of the Zener diode DZ11 occurs and therefore the current flows from the ground reference terminal through the diode DZ11 (while the current across the integrating capacitor C4 becomes null), thus limiting the value of the voltage across the integrating capacitor C4 to a value equal to the Zener voltage V_DZ11 of the Zener diode DZ11 (for example equal to −15 Volts); therefore in an instant comprised between t6 and t7 the integrating voltage V_int_I_ion reaches a value equal to the Zener voltage V_DZ11 of the Zener diode DZ11 (for example, −15 Volts) and in the subsequent instants the integrating voltage V_int_I_ion has a substantially constant trend equal to the Zener voltage V_DZ11 of the Zener diode DZ11 (for example, −15 Volts).

It should be noted that in the known solutions which measure the ionization current, the bias capacitor C6 is maintained charged during the entire step of measuring the ionization current (i.e., it is necessary to maintain the voltage V_C6 across the bias capacitor C6 substantially constant at a value other than zero Volts).

Otherwise, according to the invention it is sufficient (by means of the charging of the integrating capacitor C4 and simultaneous discharging of the bias capacitor C6, and vice versa) to maintain (during the third step of measuring the ionization current) the bias capacitor C6 charged for a shorter time interval than the length of the third step of measuring the ionization current, thus allowing use of the bias capacitor C6 with much lower capacitance values (thus the bias capacitor C6 has smaller dimensions); for example, FIG. 2A shows that the voltage drop V_C6 across the bias capacitor C6 reaches a very small value (at the null limit) approximately at the time instant t7 in which the ionization current I_ion has reached the null value, but it is also possible that the voltage VC_6 reaches a very small value in a time instant before or after the time instant t7, in the latter case at a distance from the instant t7 which is much smaller than the distance from the instant t10.

For example, the value of the capacitance of the bias capacitor C6 has values between 50 nF (nanofarad) and 150 nF.

At the instant t10 the first ignition cycle ends and the second ignition cycle begins, in which it is assumed that a correct combustion of the air-fuel mixture occurs again.

The operation between the instants t10 and t12 (first step of charging energy) of the second ignition cycle is similar to that described above between the instants t1 and t2 of the first ignition cycle, with the difference that the integrating capacitor C4 begins to slowly discharge and is partially discharged through the charge seen from the terminal O4 of the integrating capacitor C4.

Moreover at the instant t10 the control signal S_ctrl has a rising edge and the local control unit 9 generates the combustion monitoring voltage S_id carrying a voltage pulse I2 having a rising edge, which will be used by the Electronic Control Unit 20 to detect the presence in the first cycle of the correct combustion of the air-fuel mixture in the combustion chamber of the cylinder of the engine in which the spark plug 3 is mounted.

In particular, the local control unit 9 receives the integrating voltage V_int_I_ion representative of a value directly proportional to the measurement of the integral of the ionization current I_ion in the first ignition cycle and generates the combustion monitoring voltage S_id carrying the voltage pulse I2 having a length ΔT2 directly proportional to the value of the integrating voltage V_int_I_ion of the step of measuring the ionization current I_ion of the first ignition cycle.

Therefore, in the instants comprised between t10 and t12, the local control unit 9 transmits to the Electronic Control Unit 20 the combustion monitoring voltage S_id carrying the voltage pulse I2 having a length ΔT2; the Electronic Control Unit 20 receives the combustion monitoring voltage S_id, performs the comparison between the value of the temporal length ΔT2 and the value of the ignition threshold, detects that the value of the temporal length ΔT2 is greater than the value of the ignition threshold and therefore detects that in the first ignition cycle a misfire of the air-fuel mixture has not occurred in the combustion chamber of the cylinder of the engine in which the spark plug 3 is mounted (i.e., in the first cycle a correct spark occurred between the electrodes of the spark plug 3, i.e., a correct combustion of the air-fuel mixture occurred).

The operation between the instants t12 and t15 (second step of transferring energy in which the spark occurs) of the second ignition cycle is equal to that described previously between the instants t2 and t5 of the first ignition cycle.

In particular, between the instants t12 and t13 of the second cycle (t13 near t12) the rapid discharge of the residual voltage across the integrating capacitor C4 occurs (which was charged in the previous step of measuring the ionization current of the first cycle) by means of the flow of the secondary current I_sec, until reaching at the instant t13 a substantially null value (for example, approximately 0.7 Volts) of the voltage across the integrating capacitor C4 by means of the forward biasing of the Zener diode DZ11: in this way the integrating capacitor C4 (completely discharged) is ready to be used to store the charge generated in the step of measuring the ionization current of the second cycle, therefore the integrating circuit 7 is automatically reset, without requiring the intervention of the driving unit 5 or the Electronic Control Unit 20.

It should be noted that the discharge of the residual voltage across the integrating capacitor C4 during the first step of the second cycle occurs much more slowly than that during the second step of the second cycle.

Therefore during the steps of charging and transferring energy of the second cycle (instants comprised between t10 and t15), the integrating voltage V_int_I_ion has an increasing trend from the maximum negative value Vint_max to a substantially null value (for example, approximately 0.7 Volts) at the instant t13 and then is maintained equal to the substantially null value (see FIG. 2B), wherein said substantially null value is reached at an instant t13 not very far from the instant t12.

The operation between the instants t15 and t20 (third step of measuring the ionization current) of the second ignition cycle is similar to that described above between the instants t5 and t10 of the first ignition cycle, therefore the bias capacitor C6 is discharged at least partially by means of the flow of the ionization current I_ion through the secondary winding 2-2 and the integrating capacitor C4 is charged towards a negative value, thus measuring a value proportional to the integral of the ionization current I_ion by means of the detection of the integrating voltage signal V_int_I_ion across the integrating capacitor C4.

In the instants comprised between t17 and t20 the ionization current I_ion has a substantially null value, as the activity of the spark plug 3 on the electrodes has finished.

At the instant t20 the second ignition cycle ends and the third ignition cycle begins, in which a misfire occurs.

The operation between the instants t20 and t22 (first step of charging energy) of the third ignition cycle is similar to that described previously between the instants t10 and t12 of the second ignition cycle.

In particular, at the instant t20 the control signal S_ctrl has a rising edge and the local control unit 9 generates the combustion monitoring voltage S_id carrying a voltage pulse I3 having a rising edge, which will be used by the Electronic Control Unit 20 to detect the presence in the second cycle of the correct combustion of the air-fuel mixture in the combustion chamber of the cylinder of the engine in which the spark plug 3 is mounted.

In particular, the local control unit 9 receives the integrating voltage V_int_I_ion representative of a value directly proportional to the measurement of the integral of the ionization current I_ion in the second ignition cycle and generates the combustion monitoring voltage S_id carrying the voltage pulse I3 having a length ΔT3 directly proportional to the value of the integrating voltage V_int_I_ion of the step of measuring the ionization current I_ion of the second ignition cycle.

Therefore in the instants comprised between t20 and t22, the local control unit 9 transmits to the Electronic Control Unit 20 the combustion monitoring voltage S_id carrying the voltage pulse I3 having a length ΔT3; the Electronic Control Unit 20 receives the combustion monitoring voltage S_id, performs the comparison between the value of the temporal length ΔT3 and the ignition threshold, detects that the value of the temporal length ΔT3 is greater than the value of the ignition threshold and therefore detects that in the second ignition cycle a misfire of the air-fuel mixture has not occurred in the combustion chamber of the cylinder of the engine in which the spark plug 3 is mounted (i.e., in the second cycle a correct spark occurred between the electrodes of the spark plug 3, i.e., a correct combustion of the air-fuel mixture occurred).

The operation between the instants t22 and t25 (second step of transferring energy) of the third ignition cycle is similar to that described previously between the instants t12 and t15 of the second ignition cycle.

Otherwise, the operation between the instants t25 and t30 (third step of measuring the ionization current and measuring the integral of the ionization current) of the third ignition cycle is different from that between the instants t15 and t20 of the second ignition cycle, as in the third cycle a misfire of the air-fuel mixture has occurred in the combustion chamber of the cylinder of the engine in which the spark plug 3 is mounted.

In particular, in the instants comprised between t25 and t30 of the third cycle the value of the ionization current I_ion which flows through the secondary winding 2-2 is substantially null due to a misfire of the air-fuel mixture and therefore the integrating capacitor C4 does not charge, but is maintained discharged at a substantially null value; consequently, during the third step of the third cycle the integrating voltage V_int_I_ion having substantially null values is detected, i.e., the measured value of the integral of the ionization current I_ion in the third step of the third cycle is approximately equal to zero.

At the instant t30 the third ignition cycle ends and the fourth ignition cycle begins, which is only partially shown in FIG. 2C.

In particular, FIG. 2C shows that at the instant t30 the control signal S_ctrl has a rising edge and the local control unit 9 generates the combustion monitoring voltage S_id carrying a voltage pulse I4 having a rising edge, which will be used by the Electronic Control Unit 20 to detect the presence in the third cycle of the misfire of the air-fuel mixture in the combustion chamber of the cylinder of the engine in which the spark plug 3 is mounted.

In particular, the local control unit 9 receives the integrating voltage V_int_I_ion having an approximately null value since in the third ignition cycle the measurement of the integral of the ionization current I_ion is approximately equal to zero due to the misfire, thus the local control unit 9 generates the combustion monitoring voltage S_id carrying the voltage pulse I4 having a very small length ΔT4.

Therefore in the instants comprised between t30 and t30.1, the local control unit 9 transmits to the Electronic Control Unit 20 the combustion monitoring voltage S_id carrying the voltage pulse I4 having a very small length ΔT4; the Electronic Control Unit 20 receives the combustion monitoring voltage S_id, performs the comparison between the value of the temporal length ΔT4 and the ignition threshold, detects that the value of the temporal length ΔT4 is smaller than the value of the ignition threshold and therefore detects that in the third ignition cycle a misfire of the air-fuel mixture has occurred in the combustion chamber of the cylinder of the engine in which the spark plug 3 is mounted (i.e., in the third cycle a correct spark has not occurred between the electrodes of the spark plug 3, i.e., a correct combustion of the air-fuel mixture has not occurred).

It should be observed that for the purposes of the previous explanation of the operation of the invention it has been considered for simplicity that in the case of a correct combustion of the air-fuel mixture, the length ΔT of the pulses of the combustion monitoring voltage S_id is directly proportional to the (absolute) value detected of the integrating voltage V_int_I_ion, but more in general the invention is applicable to the case in which the length ΔT of the pulses of the combustion monitoring voltage S_id is increasing with the increase of the (absolute) value detected of the integrating voltage V_int_I_ion.

It should also be observed that the driving unit 5 and the local control unit 9 can also be realized with a single electronic component which performs both the function of driving the driving unit 5, and the control function of the local control unit 9; in other words, the local control unit 9 can be incorporated within the driving unit 5, or vice versa.

It should be observed that FIGS. 2A-2C show the case in which the combustion monitoring voltage S_id carries temporal pulses I1, I2, I3, I4 representative of the presence or absence of a misfire in the previous cycle, i.e.:

- the temporal length ΔT1 of the first voltage pulse I1 is positioned inside the first charging step of the first cycle, but it is representative of the absence of a misfire in the cycle (not shown in FIGS. 2A-2C) prior to the first cycle between t1 and t10;
- the temporal length ΔT2 of the second voltage pulse I2 is positioned inside the first charging step of the second cycle, but it is representative of the absence of a misfire of the first cycle between t1 and t10;
- the temporal length ΔT3 of the third voltage pulse I3 is positioned inside the first charging step of the third cycle, but it is representative of the absence of a misfire of the second cycle between t10 and t20;
- the temporal length ΔT4 of the fourth voltage pulse I4 is positioned inside the first charging step of the fourth cycle, but it is representative of the presence of a misfire in the third cycle between t20 and t30.

Alternatively, it is also possible to generate the combustion monitoring voltage S_id so that it carries temporal pulses I1, I2, I3 representative of the presence or absence of a misfire in the same cycle, i.e.:

- the temporal length ΔT1 of the first voltage pulse I1 is positioned inside the first charging step of the first cycle, and it is representative of the absence of a misfire of the first cycle between t1 and t10;
- the temporal length ΔT2 of the second voltage pulse I2 is positioned inside the first charging step of the second cycle, and it is representative of the absence of a misfire of the second cycle between t10 and t20;
- the temporal length ΔT3 of the third voltage pulse I3 is positioned inside the first charging step of the third cycle, and it is representative of the presence of a misfire in the third cycle between t20 and t30.

Figure 3:
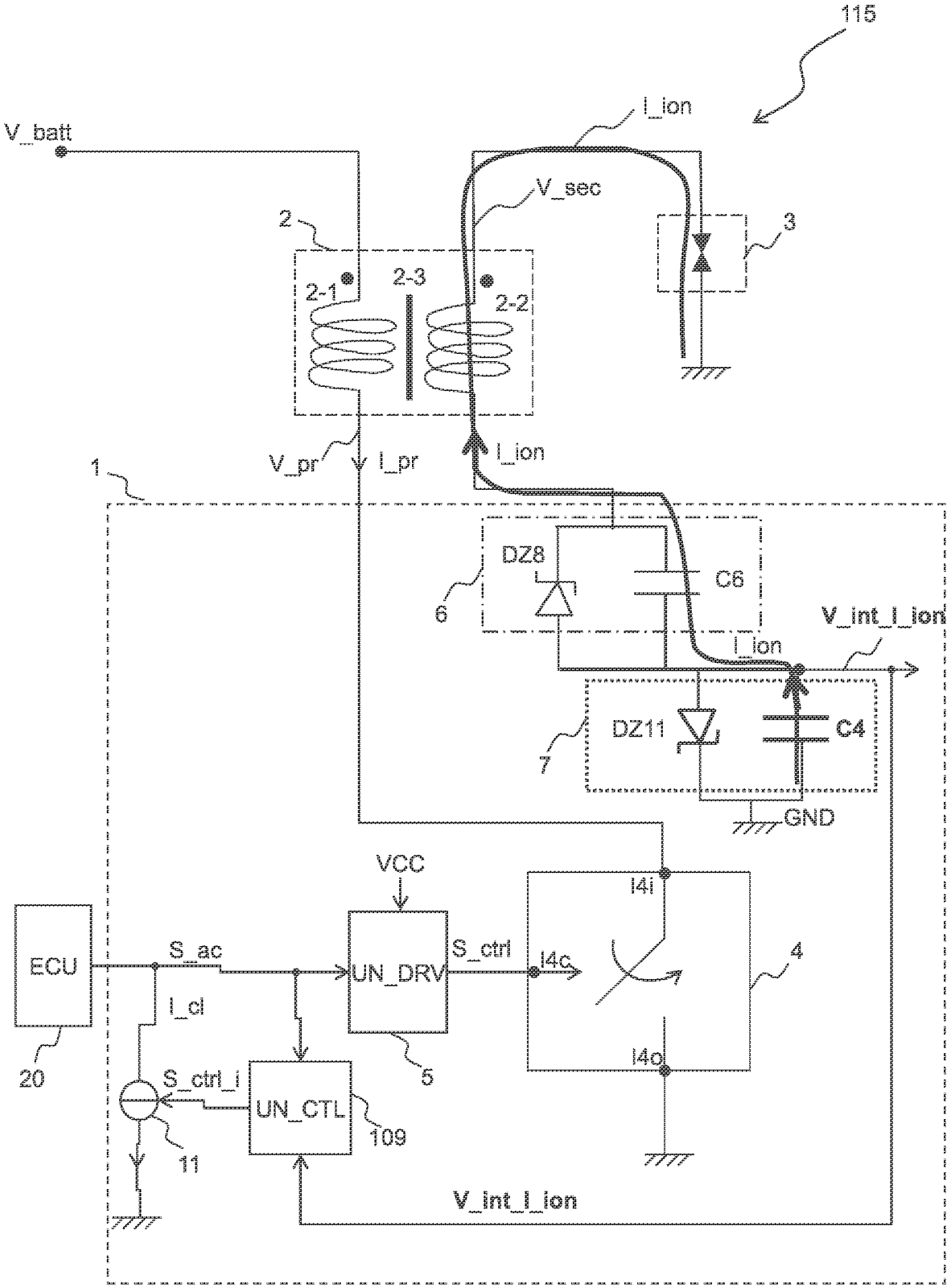
FIG. 3 shows the block diagrams of the electronic ignition system according to a variant of the embodiment of the invention.

With reference to FIG. 3, an electronic ignition system 115 is illustrated according to a variant of the embodiment of the invention.

The ignition system 115 of FIG. 3 differs from that of FIGS. 1A-C in that it further comprises a current generator 11 controlled as a function of the value of a current control signal S_ctrl_i generated by the local control unit 109 (similar to 9): in this way it is possible to avoid the use of an additional connection between the local control unit 109 and the Electronic Control Unit 20 for transferring the combustion monitoring signal S_id.

In particular, the current generator 11 is configured to generate a trigger current I_cl having a value which depends on the value of the current control signal S_ctrl_i, which in turn depends on the detected value of the integrating voltage V_int_I_ion.

Figure 4A:
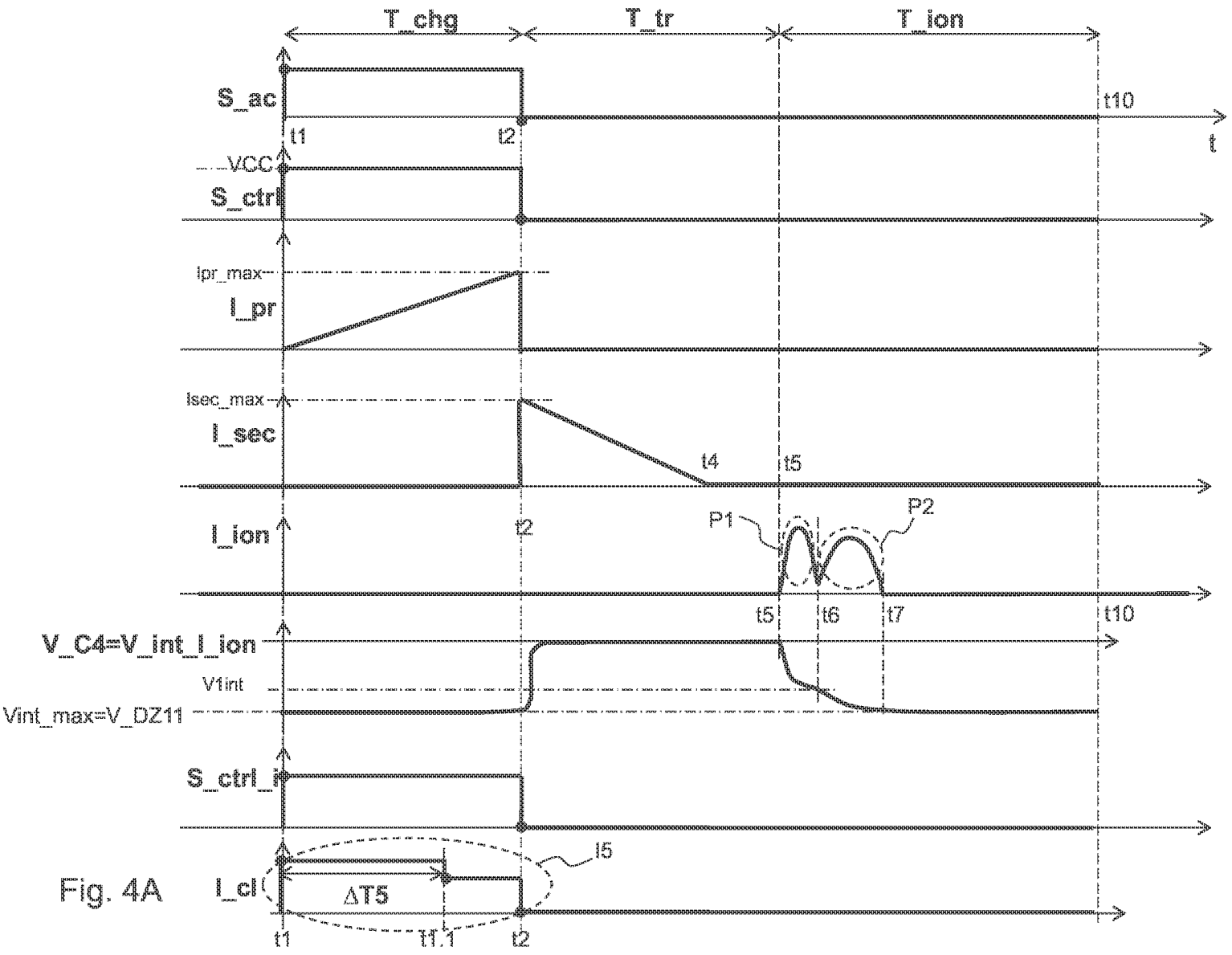
FIGS. 4A-4C schematically show a possible trend of some signals generated in the electronic ignition system according to the variant of the embodiment of the invention.
Figure 4B:
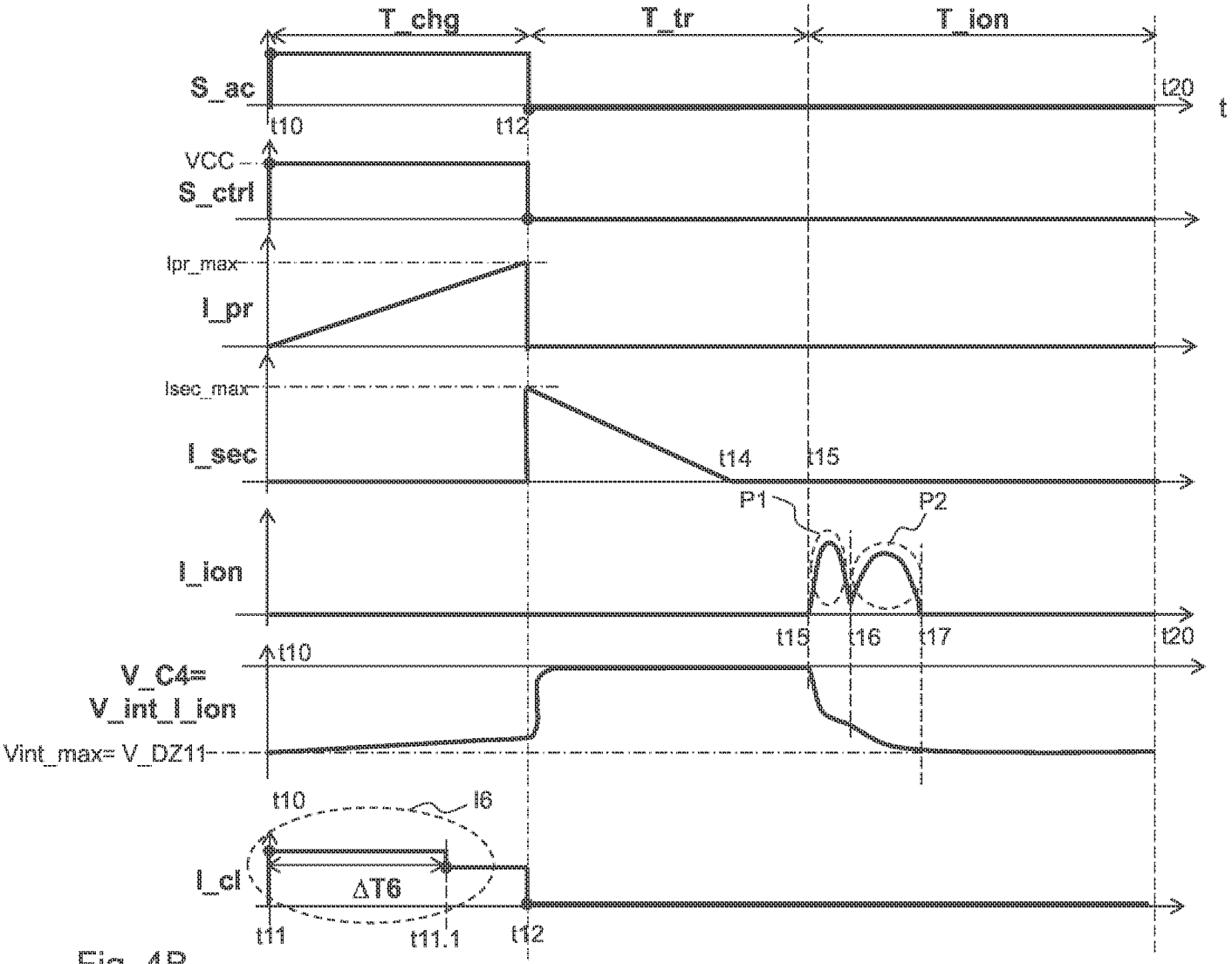
Figure 4C:
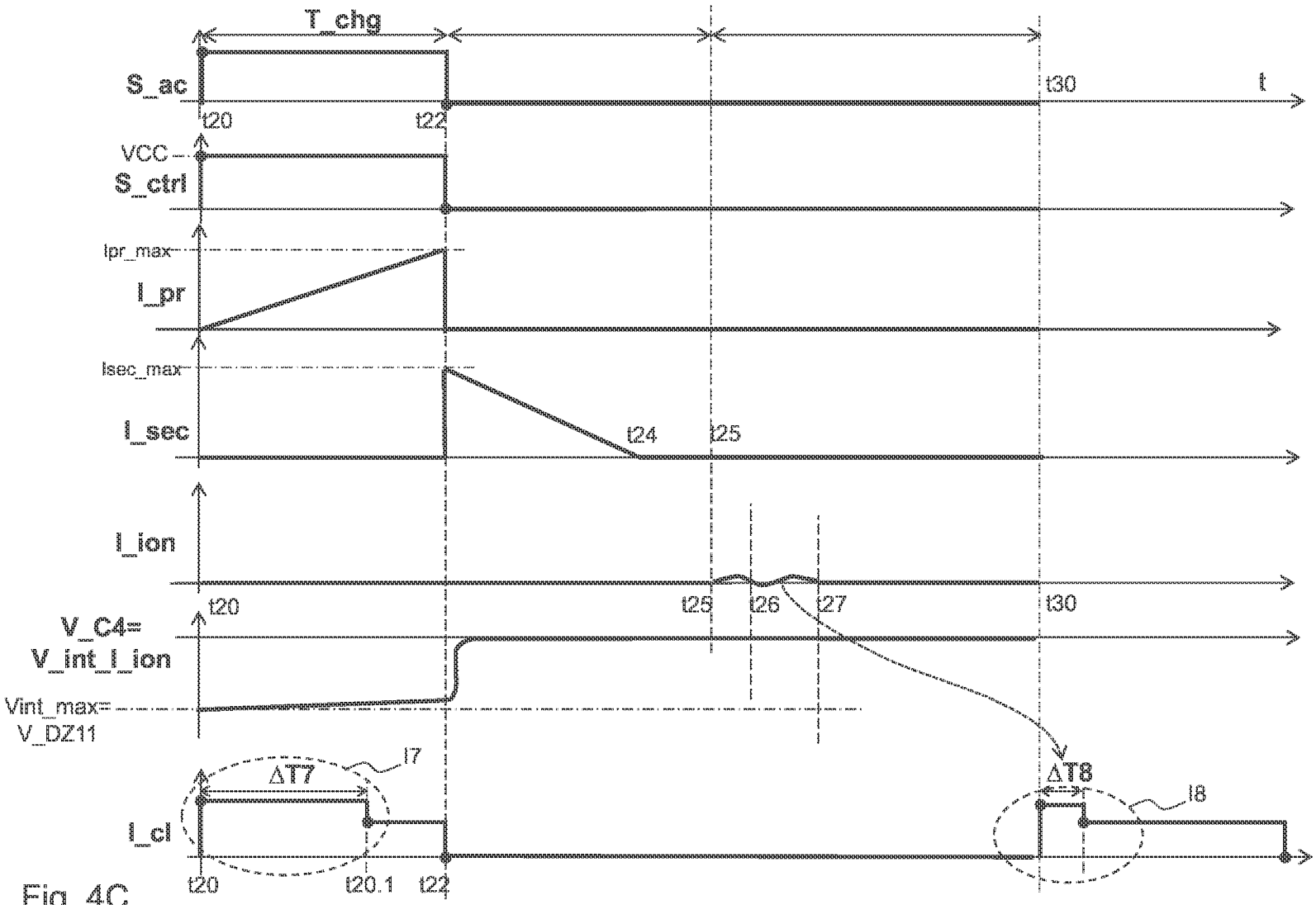

More in particular, in the variant of the invention the distance between two edges of the variation of a pulse of the trigger current I_cl is used (see the pulses I5, I6, I7, I8 and respective lengths ΔT5, ΔT6, ΔT7, ΔT8 in FIGS. 4A-C) to determine in each combustion cycle the presence or absence of a misfire in the previous cycle, i.e., the length between the two edges of the current pulse is directly proportional to the value of the integrating voltage signal V_int_I_ion during the step of measuring the ionization current of the previous cycle.

The local control unit 9 comprises a first input terminal adapted to receive the ignition signal Sac, comprises a second input terminal adapted to receive the integrating voltage signal V_int_I_ion representative of the measured value of the integral of the ionization current I_ion (measured by means of the voltage drop across the integrating capacitor C4 of the integrating circuit 7) and comprises an output terminal adapted to generate, as a function of the value of the ignition signal Sac and the detected value of the integrating voltage V_int_I_ion, the current control signal S_ctrl_i to control the value of the trigger current I_cl generated by the current generator 11.

With reference to FIGS. 4A-4C, the trend of some signals of the electronic ignition system 115 of FIG. 3 is shown.

The case is considered in which the length between the two edges of the variation of the trigger current I_cl of a cycle is representative of the presence or absence of a misfire of a previous cycle.

In particular, it is assumed that in the first cycle between t1 and t10 a correct combustion of the air-fuel mixture occurs, that in the second cycle between t10 and t20 a correct combustion occurs and that in the third cycle between t20 and T30 a misfire occurs.

It can be observed that the value of the lengths ΔT6 and ΔT7 between two variation edges of the trigger current I_cl in the second and third ignition cycle are much greater than the length ΔT8 between two variation edges of the trigger current I_cl in the fourth cycle, as in the first and second cycle a proper ignition of the air-fuel mixture occurred, while in the third cycle a misfire of the air-fuel mixture occurred.

It should be observed that for the purposes of explanation of the invention the case was considered of a misfire of the comburent-combustible mixture (for example, air-fuel) in the combustion chamber of the cylinder in which the spark plug 3 is mounted, but more in general the invention is applicable to the case in which a combustion of the comburent-combustible mixture of an insufficient entity occurs in the combustion chamber (i.e., an insufficient spark occurs between the electrodes of the spark plug 3); therefore the previous considerations concerning misfire are applicable in a similar way to the case of an insufficient combustion.

Figure 5:
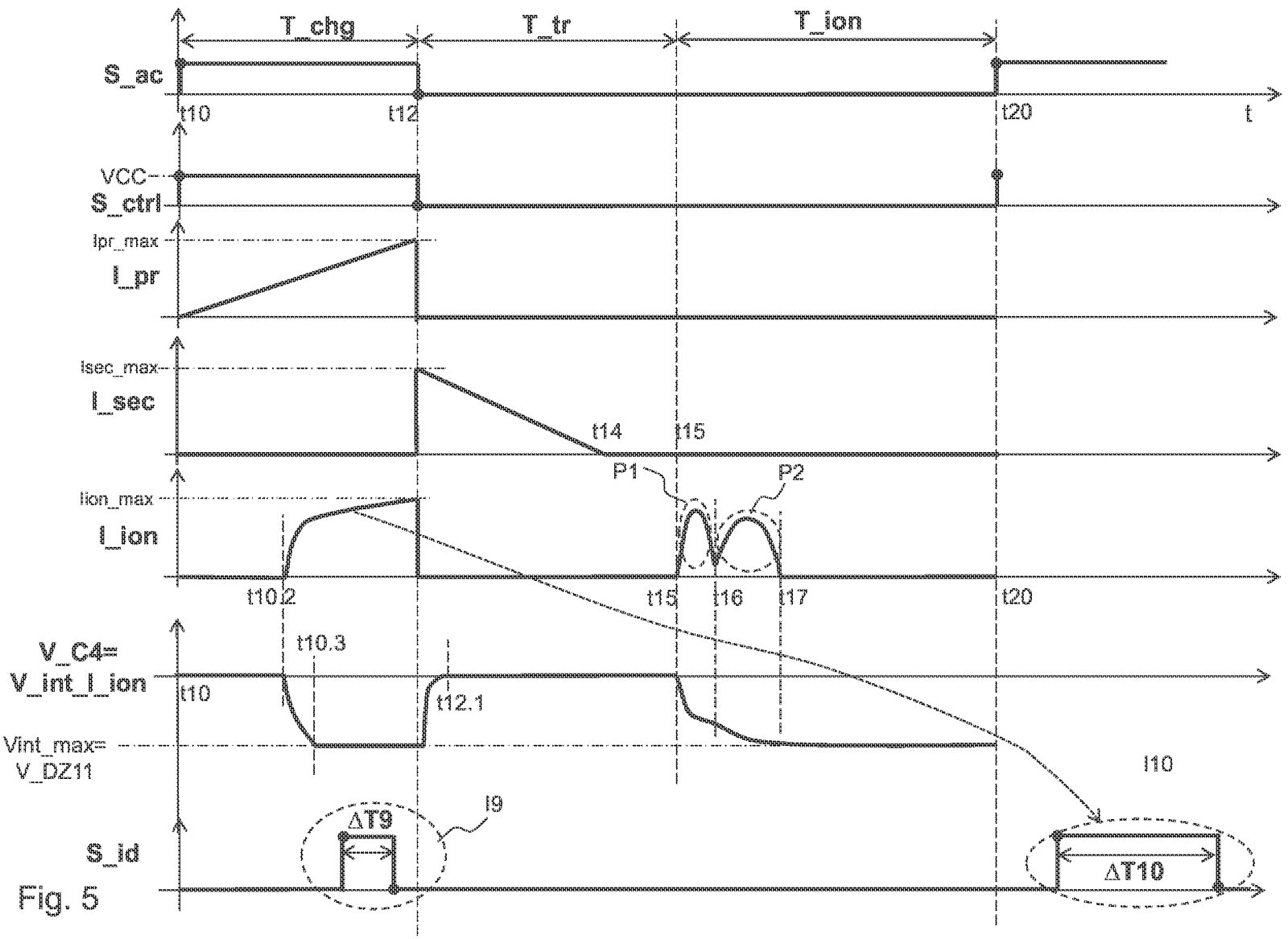
FIG. 5 schematically shows a possible trend of some signals generated in the electronic ignition system according to the invention, in the case in which a pre-ignition of the comburent-combustible mixture occurs.

With reference to FIG. 5, the trend of the signals in the ignition system is shown in the case of a pre-ignition of the air-fuel mixture during the first step of charging energy in the primary winding 2-1: in this case an ionization current I_ion is generated through the secondary winding 2-2 also during the first step of charging energy in the primary winding 2-1.

FIG. 5 represents an ignition cycle similar to that of FIG. 2B, with the difference that the ionization current I_ion has an increasing trend from the null value to a maximum value Iion_max between the instants t10.2 and t12 of the first step of charging energy in the primary winding 2-1 since a pre-ignition of the air-fuel mixture occurred starting from the instant t10.2; accordingly, during the first step of charging, a pre-charge of the integrating capacitor C4 occurs, thus the integrating signal V_int_I_ion (i.e., the value of the integral of the ionization current I_ion) is null between the instants t10 and t10.2, then at the instant t10.2 it starts to have a decreasing monotonic trend until reaching the maximum negative value Vint_max (equal for example to the Zener voltage V_DZ11 of the Zener diode DZ11) in an instant t10.3 between the instants t10.2 and t12.

Subsequently in the second step of transferring energy the integrating signal V_int_I_ion has a trend increasing rapidly towards the null value due to the rapid discharge of the integrating capacitor C4, thus the integrating signal V_int_I_ion maintains the value substantially null (for example, equal to 0.7 Volts) during the remaining time interval of the second step of transferring energy between t12.1 and t15.

Finally in the third step of measuring the ionization current (instants between t15 and t20) the trend of the integrating signal V_int_I_ion is similar to that previously described for the second cycle of the embodiment of the invention of FIG. 2B, i.e., starting from the instant t15 it has a decreasing trend from the null value until reaching the maximum negative value Vint_max at the instant t17 due to the charging of the integrating capacitor C4, thus the integrating signal V_int_I_ion has a substantially constant trend equal to Vint_max in the remaining time interval of the third step comprised between t17 and t20.

In the case in which a pre-ignition of the air-fuel mixture does not occur in the combustion chamber during the charging step, the integrating capacitor C4 maintains the charge state substantially constant, i.e., a substantially null value (as shown in FIG. 5) or a value equal to the Zener voltage V_DZ11 of the diode DZ11 (as shown in FIG. 2A).

The previous considerations relating to the voltage pulses of FIGS. 2A-2C and the current pulses of FIGS. 4A-4C for misfire are applicable in a similar way to pre-ignition, with the difference that the voltage or current pulses are positioned at the end of the first step of charging energy.

Therefore the voltage pulse (see I9 and I10 in FIG. 5) carried from the monitoring signal S_id is positioned in the final part of the ignition signal S_ac in which it has a high value and is related to the presence or absence of a pre-ignition in the previous cycle, and has an opposite meaning with respect to that of the detection of a misfire, i.e.:

- if the length ΔT is less than the value of a pre-ignition threshold, it means that a pre-ignition did not occur in the previous cycle,
- if the length ΔT is greater than or equal to the value of the pre-ignition threshold, it means that a pre-ignition occurred in the previous cycle.

Considering the example shown in FIG. 5, the voltage pulse I9 in the second cycle has a length ΔT9 less than the value of the pre-ignition threshold because a pre-ignition did not occur in the first cycle, while the voltage pulse I10 in the third cycle has a length ΔT9 greater than the value of the pre-ignition threshold because a pre-ignition occurred in the second cycle.

Figure 7A:
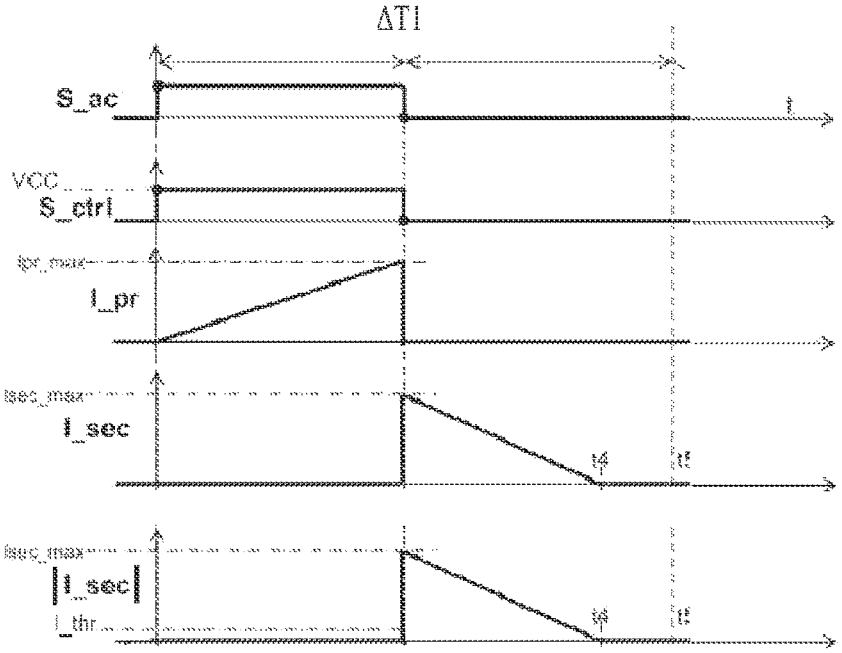
FIGS. 7*a* and 7*b* schematically show a possible trend of some signals generated in the electronic ignition system during the implementation of a method of monitoring a soiling condition of a spark plug according to one aspect of the present invention, both in a zero soiling condition (clean spark plug) and in a high soiling condition.
Figure 7B:
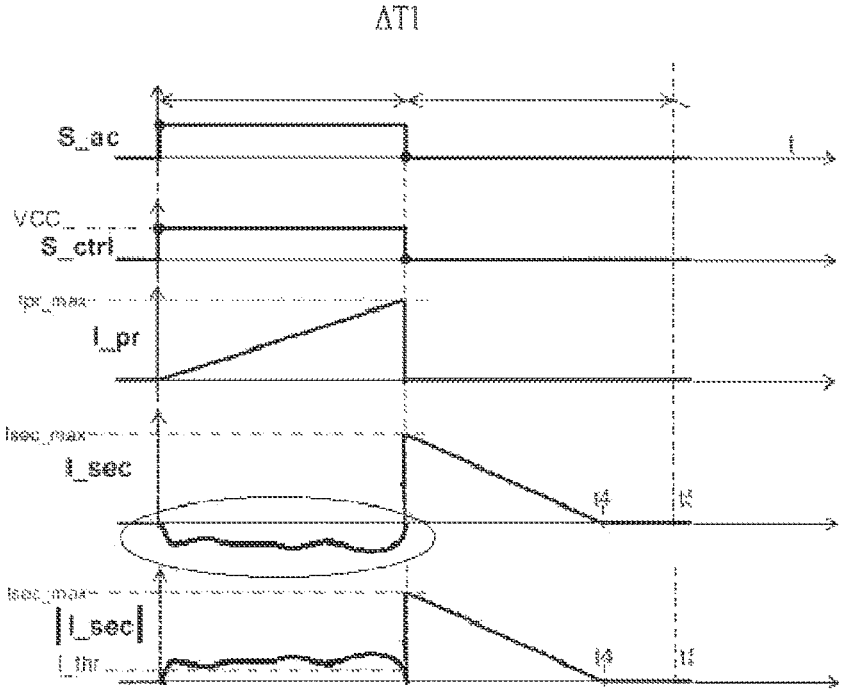

With reference to what is illustrated in FIGS. 7*a* and 7*b*, the trend of the signals in the ignition system is shown in the case in which a soiling of the spark plug occurs.

Figure 6:
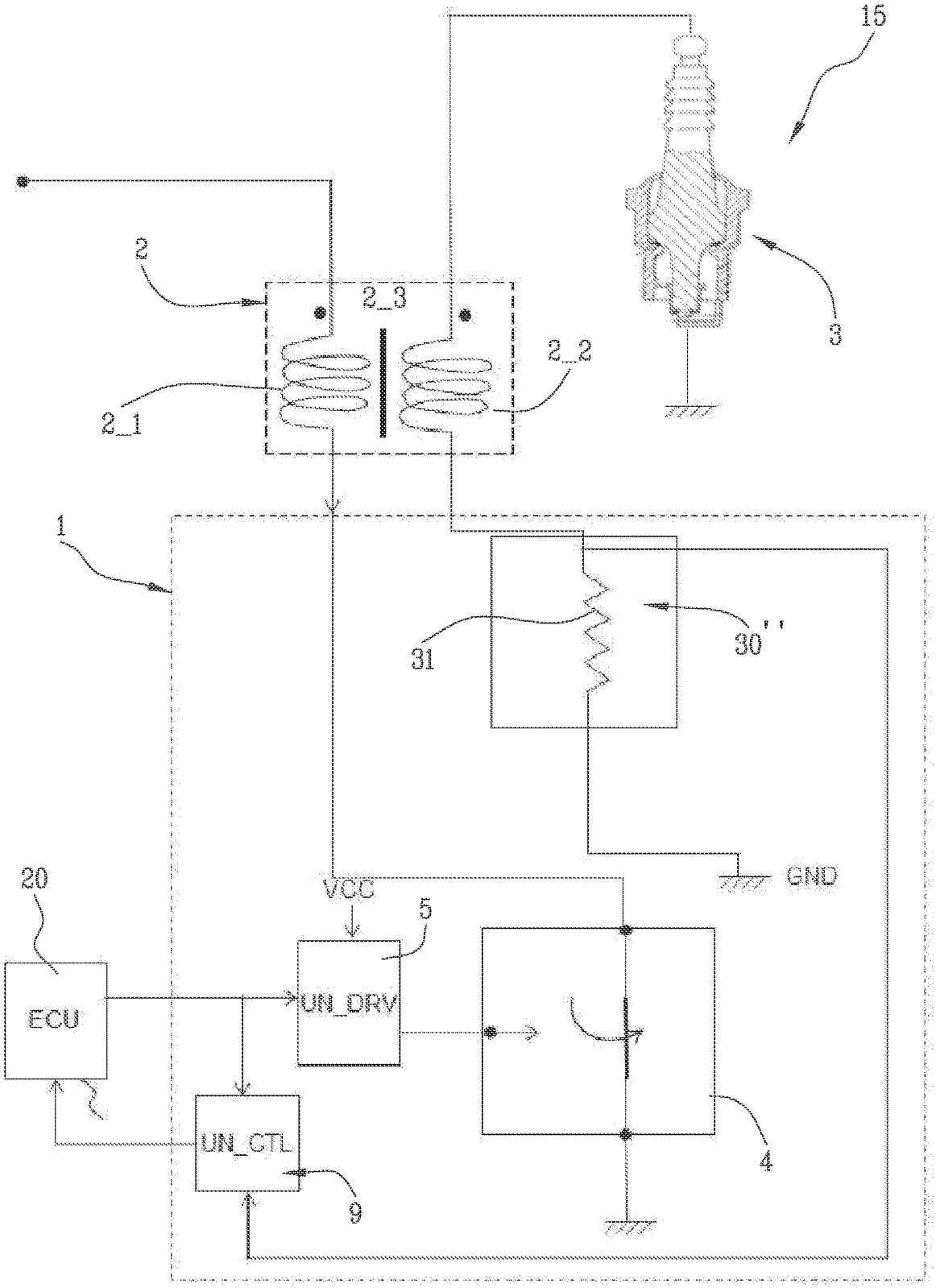
FIG. 6*a* shows a block diagram of an electronic ignition system according to an embodiment of the invention.

Such signals may be detected by a device analogous to that of FIG. 1 or alternatively by the device 1 (and system 15) illustrated in FIG. 6.

It should be noted that, consistently with what has been described up to now, in the following description, identical or analogous blocks, components or modules are indicated in the figures with the same numerical references, even where they are illustrated in different embodiments of the invention.

The electronic control device 1, analogous to the embodiments described above, comprises a high voltage switch 4 and a driving unit 5.

The high voltage switch 4 is connected in series to the primary winding 2-1 of the coil and configured to switch between a closed position and an open position.

The driving unit 5 is configured to control the closure of the high voltage switch 4 during a step of charging energy T_chg in the primary winding 2-1 and to control the opening of the high voltage switch 4 during a step of transferring energy T_tr from the primary winding to a secondary winding of the coil.

Furthermore, the device 1 comprises a measuring circuit 30', 30" of the current connected in series to the second terminal of the secondary winding 2-2.

The measuring circuit 30', 30" is configured to detect the flowing current on the secondary winding 2-2 at least during the charging step T_chg.

Such measuring circuit 30' may for example comprise a bias circuit 6 and an integrating circuit 7 similar to those described heretofore.

Alternatively, however, the measuring circuit 30" could comprise a resistor 31 arranged electrically in series at the second end of the secondary winding 2-2 in order to make the flowing current in the winding measurable, as illustrated in FIG. 6.

The measuring circuit 30', 30" is thus configured to generate a signal representative of the current detected on the secondary winding.

More precisely, the measuring circuit 30', 30" is connected to a control unit, whether it is the local control unit 9 or the Electronic Control Unit 20.

In the preferred embodiment, the measuring circuit 30', 30" is connected to the local control unit 9 to provide the same with the signal representative of the detected current.

However, the same operations reported below with reference to such local control unit 9 could also be performed by the Electronic Control Unit 20, or by another processing unit associated with the measuring circuit 30', 30".

The control unit 9 is thus configured to receive said signal representative of the current detected by the measuring circuit 30', 30" and compare a relevant value of said signal with at least one predefined (or preset) first reference value I_thr.

The expression "relevant value" herein refers to a value which is representative of the level of flowing current in the secondary winding 2-2 during the charging step T_chg and, preferably, is robust and at the same time simple to detect.

In a first embodiment, the relevant value of the representative signal of the current is defined by a peak value (in module/absolute value) of the representative signal during said charging step T_chg.

It should be noted that the expression "peak (or maximum) value" herein does not necessarily refer to the maximum peak reached by the representative signal, but preferably to any peak (mathematical) point within the time interval defining the charging step T_chg.

Alternatively, the relevant value of the representative signal of the current could be defined by an average value (in module/absolute value) of the representative signal during said charging step T_chg.

Advantageously, this solution would be more robust to any spikes or disturbances.

In a further alternative, the relevant value of the representative signal of the current is defined by the integral value of the representative signal during said charging step T_chg.

This solution, defined by the device of FIG. 1, has technical advantages connected to a greater robustness connected to a greater possibility of signal processing/filtering.

In any case, preferably the relevant value represents the module/absolute value of the real detected or calculated value, as the current which is created in the secondary due to soiling generally has a negative sign (with respect to the primary).

In the preferred embodiment, the relevant value of the representative signal of the current is defined by the integral value of the signal and is detected by means of an integrating circuit 7 interposed between a bias circuit 6 and the reference voltage GND, all of which have already been described previously with reference to pre-ignition and misfire.

Thus, in the preferred embodiment all the technical features relating to the bias circuit 6 and the integrating circuit 7 described with reference to pre-ignition are also applicable, mutatis mutandis, to the detection of spark plug soiling.

The integrating circuit 7 is therefore configured to pre-charge during the energy charging step in the primary winding if during this charging step T_chg a current flows inside the secondary winding 2-2.

Thereby, the integrating circuit 7 measures a value of the integral of the ionization current flowing through the secondary winding during the charging step due to the soiling of the spark plug 3.

According to an aspect of the invention, in fact, the control unit 9 is further configured to activate a mode for detecting the soiling of the spark plug 3 when said relevant value of the signal exceeds said predefined first reference value I_thr.

Preferably, the first reference value I_thr (predefined or preset) is between 80 μA and 8000 μA, preferably between 100 μA and 2000 μA.

The term "soiling" herein refers to defining that at least part of the spark plug 3, in particular the ceramic insulator of the central electrode, is covered with a soot deposit which, being of carbonaceous origin, is conductive.

In fact, in a condition of little or no soiling, the current flowing in the secondary winding 2-2 during the charging step T_chg is substantially zero. Conversely, as the soiling condition of the spark plug 3 increases, the carbonaceous layer which is deposited on the insulating body creates a "contact" between the electrodes which establishes an electron flow.

Advantageously, thanks to the presence of the detection circuit and the setting of a comparison step referring to the charging step T_chg, it is possible to detect the possible presence of soiling on the spark plug 3 without making particular structural changes to the coil and spark plug 3.

In more detail, the integrating circuit comprises an integrating capacitor C4 connected in series to the bias circuit 6 and connected between the bias circuit and the reference voltage.

The integrating capacitor is configured to:

- pre-charge during the energy charging step in the primary winding by means of the current flowing through the secondary winding 2-2 during the charging step T_chg (in case of soiling)
- maintain the charge state substantially constant during the energy charging step if the current flowing in the secondary winding 2-2 is substantially zero ("clean" spark plug);
- completely discharge by means of the current flowing through the secondary winding during the step of transferring energy (T_tr) from the primary winding to the secondary winding.

The current value with which the integrating capacitor C4 is charged is then compared to the first reference value I_thr and, if it exceeds this value, a soiling condition of the spark plug is detected.

In the preferred embodiment, the control unit 9 is further configured to compare said significant current value also with a second reference value, less than the first reference value I_thr.

The control unit 9 is therefore programmed to:

- identify a low soiling condition of the spark plug 3 if said relevant value is greater than said second reference value but less than said first reference value I_thr;
- identify a condition of high soiling of the spark plug 3 if said relevant value is greater than said first reference value I_thr.

Advantageously, in this way it is possible not only to identify the presence or not of a soiling, but also to discriminate between two (or more) levels of soiling, facilitating the calibration of the remedies to be implemented and/or the communications to be sent to the driver.

In this regard, preferably the second reference value is between 60 and 100 μA, more preferably between 70 and 90 μA.

In such an embodiment, the first reference value I_thr is instead between 500 and 2000 μA, more preferably between 700 and 1500 μA.

Furthermore, in the preferred embodiment, a third, maximum reference value is provided, preferably greater than 5000 μA (more preferably greater than 7000 μA).

According to this embodiment, the control unit 9 is configured to compare said significant current value also with the third reference value and to send the Electronic Control Unit 20 a signal representative of the need to replace the spark plug 3.

From a structural point of view, preferably the integrating circuit 7 comprises the connection in parallel of the integrating capacitor C4 and a Zener diode DZ11, the Zener diode having an anode terminal connected to the bias circuit and having a cathode terminal connected to the reference voltage.

During the step of measuring the ionization current the Zener diode DZ11 is reversely biased and is configured to limit the voltage across the integrating capacitor C4 during the charging thereof to a maximum defined value Vint_max equal to the Zener voltage of the Zener diode DZ11.

During the energy transfer step the Zener diode DZ11 is forwardly biased and is configured to bias the voltage across the integrating capacitor C4 to a substantially null value.

In the case of soiling of the spark plug, the integrating capacitor C4 is configured to charge until reaching a voltage across itself having an absolute value equal to the Zener voltage V_DZ11 of the Zener diode DZ11.

It should be noted that, preferably, the electronic device 1 is inserted inside an electronic ignition system 15, provided not only with this device but also with the Electronic Control Unit 20 and the ignition coil 2.

Preferably, in this regard, the control unit 9 (local) is configured to send to the Electronic Control Unit 20 an alarm signal following the activation of said mode for detecting a soiling of the spark plug 3.

The electronic control unit 20 is in turn configured to activate a cleaning procedure of the spark plug 3 upon receipt of said alarm signal.

Advantageously, in this way, the detection is not limited to indicating the condition of the spark plug 3 and/or the moment in which the same must be replaced, but contributes to extending the useful life thereof by means of actions aimed at reducing the soiling.

Preferably, during such a spark plug 3 cleaning procedure, the electronic control unit 20 is configured to raise the temperature at the electrodes of the spark plug 3 in order to eliminate the carbonaceous residues.

Note, however, that the spark plug 3 cleaning procedure may alternatively be started directly by the local control unit 9 or by another processing unit associated with the coil 2.

The object of the present invention is, as previously discussed, also a monitoring method and a control method of an ignition coil in an internal combustion engine.

Such methods are preferably, but not exclusively, implemented by means of the control device and ignition system described heretofore.

In any case, everything described in relation to the system 15 and the device 1, if compatible with the implementation of the monitoring and control methods in accordance with the present invention, is applicable mutatis mutandis to the following.

Therefore, the technical features and reference numbers previously used in the description of the system 15 and the device 1 will also be valid for the subsequent description of the monitoring and control methods, except where specified.

With reference to the monitoring method, it is implemented during the charging and discharging cycles of an ignition coil for a combustion engine, in which the primary winding is cyclically charged with energy for a first time interval ΔT1 and the energy charged in the primary winding 2-1 is subsequently transferred to the secondary winding 2-2 by electromagnetic induction at the end of said first time interval ΔT1, The first time interval ΔT1 corresponds to the charging step T_chg, while the energy transfer takes place in the transfer step T_tr described above.

The monitoring method thus provides for detecting the flowing current on the secondary winding 2-2 during said first time interval ΔT1 and identifying a relevant value of said flowing current on the secondary winding 2-2 during the first time interval ΔT1.

In other words, the method involves detecting the secondary current during the charging step, identifying a relevant value of said current.

The relevant value, according to what has already been described above, may be of various nature, but is preferably selected from a peak value, an average value or an integral value of the flowing current in the secondary winding 2-2 in the first time interval ΔT1.

Preferably, as previously reported, the relevant value is defined by the module/absolute value of the values detected in the secondary, which by their nature are generally negative.

Further provided is a step of comparing the relevant value to at least a predefined first reference value I_thr. The first reference value I_thr preferably corresponds to that already described above, of which both features and exemplary values are applicable.

If the comparison shows that the relevant value is greater than said first reference value I_thr, the method involves identifying a soiling condition of the spark plug 3, making this information available.

Preferably, in the case of detection of soiling, a spark plug 3 cleaning procedure is initiated which, in the preferred embodiment, provides for a temperature rise at the electrodes of the spark plug 3 in order to eliminate the carbonaceous residues.

In such an embodiment, the method object of the present invention becomes a true coil control method, in that the temperature variation at the electrodes is preferably achieved by appropriately driving the coil and/or the engine, for example by increasing the engine load and/or varying the spark advance and/or by other known methods.

In the preferred embodiment of both of the methods object of the invention, in accordance with what has already been described in relation to the control device 1, the comparison step involves comparing the significant current value also with a second reference value, less than said first reference value I_thr.

Thereby, the following are identified:

- a low soiling condition of the spark plug 3 if said relevant value is greater than said second reference value, but less than said first reference value I_thr and preferably between 60 and 100 μA;
- a condition of high soiling of the spark plug 3 if said relevant value is greater than said first reference value I_thr.

Also in this case, in the preferred embodiment, the method involves comparing the relevant value also with a third reference value, greater than the first and preferably greater than 5000 μA.

If the comparison shows that the relevant value is greater than the third reference value, then the method involves generating an alarm signal, the information of which indicates a necessary replacement of the spark plug 3.

The invention achieves the intended objects and offers important advantages.

In fact, the intuition of the Applicant in monitoring the state of soiling of the spark plug by means of a comparative analysis of the secondary current during charging allows to obtain the necessary information (spark plug status) in a simple, economical and extremely robust manner.

In fact, the detection of the current prior to the establishment of the spark allows to ensure the identification of the soiling condition of the spark plug even in the event of failure to ignite, in addition to exploiting the "classic" structure of the coil in a time interval (charging step) in which analyses on the secondary winding are not generally carried out.

In fact, in this regard, this methodology is also easily applicable in ION-type solutions, where the secondary monitoring circuits and logics are extremely pushed, exploiting a temporal window in which the bias circuit and the secondary detection circuits are generally passive.

The method object of the invention is therefore not only simple and efficient, but is perfectly complementary and integratable in the current driving and control logic of the coils.

The invention claimed is:

1. An electronic ignition system for an internal combustion engine, the system comprising:

an ignition coil comprising a primary winding with a first terminal connected to a battery voltage and a secondary winding with a first terminal connected to an ignition spark plug;

an electronic control device configured for controlling the ignition coil, the electronic control device comprising:

a high voltage switch connected in series to the primary winding and configured to switch between a closed position and an open position;

a driving unit, a current measuring circuit connected in series to a second terminal of the secondary winding, a local control unit, a main electronic control unit connected to the driving unit of the electronic control device and comprising an output terminal adapted to generate an ignition signal having a first value to indicate a start of a step of charging the primary winding and having a second value to indicate a start of a step of transferring energy from the primary winding to the secondary winding, wherein the driving unit of the electronic control device is further configured to receive the ignition signal and generate, as a function thereof, a control signal of the opening and closing of the high voltage switch wherein the driving unit of the electronic control device is configured to:

control the closing of the high voltage switch during the step of charging the primary winding;

control the opening of the high voltage switch during the step of transferring energy from the primary winding to the secondary winding, wherein the current measuring circuit of the electronic control device is configured to:

detect a current generated on the secondary winding at least during the charging step, generate a signal representative of the detected current, the current measuring circuit comprising an integrating circuit including an integrating capacitor configured to:

maintain a charge state substantially constant during the charging step if the current flowing in the secondary winding is substantially zero or pre-charge during the charging step by a current flowing through the secondary winding;

completely discharge by the current flowing through the secondary winding during the step of transferring energy, wherein the charge state of the integrating capacitor defines a relevant value of the signal representative of the detected current; and wherein the local control unit of the electronic control device is configured to:

compare the relevant value with at least one predefined first reference value, activate a mode for detecting a soiling of the spark plug when the relevant value exceeds the predefined first reference value, send an alarm signal to the main electronic control unit following the activation of the mode for detecting the soiling of the spark plug, and wherein the main electronic control unit is configured to start a spark plug cleaning procedure upon receiving the alarm signal.

2. The electronic ignition system according to claim 1, wherein the current measuring circuit comprises:

a bias circuit connected in series to the second terminal of the secondary winding and configured to generate a current during the detection of the current on the secondary winding;

the integrating circuit, interposed between the bias circuit and a reference voltage;

wherein the integrating circuit comprises the integrating capacitor connected in series to the bias circuit and connected between the bias circuit and the reference voltage.

3. The electronic ignition system according to claim 2, wherein the local control unit is configured to:

compare a representative value representative of a current stored in the integrating capacitor with the predefined first reference value;

activate the mode for detecting the soiling of the spark plug when the representative value exceeds the predefined first reference value.

4. The electronic ignition system according to claim 1, wherein the predefined first reference value is between 80 μA and 8000 μA.

5. The electronic ignition system according to claim 4, wherein the predefined first reference value is between 100 μA and 2000 μA.

* * * * *